US006805440B2

(12) United States Patent
Otsuki

(10) Patent No.: US 6,805,440 B2
(45) Date of Patent: Oct. 19, 2004

(54) PRINTING UP TO PRINT MEDIUM EDGES WITHOUT PLATEN SOILING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 282 days.

(21) Appl. No.: 10/094,508

(22) Filed: Mar. 11, 2002

(65) Prior Publication Data

US 2002/0135653 A1 Sep. 26, 2002

(30) Foreign Application Priority Data

Mar. 13, 2001 (JP) ..... 2001-070476

(51) Int. Cl.[7] ..... B41J 2/01

(52) U.S. Cl. ..... 347/104; 347/22; 347/23; 347/24; 347/29; 347/35; 347/36

(58) Field of Search ..... 347/22–24, 14, 347/29, 35, 36, 104, 10, 40, 41, 42, 44

(56) References Cited

U.S. PATENT DOCUMENTS

| | | | | |
|---|---|---|---|---|
| 4,198,642 A | | 4/1980 | Gamblin | |
| 5,896,143 A | * | 4/1999 | Matsui et al. | 347/24 |
| 6,575,554 B2 | * | 6/2003 | Yoshinaga | 347/22 |

FOREIGN PATENT DOCUMENTS

| | | |
|---|---|---|
| EP | 1 043 166 A2 | 10/2000 |
| EP | 1 059 168 A2 | 12/2000 |
| JP | 2000-118058 A | 4/2000 |

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

An object of the present invention is to allow images to be printing all the way to the edge portions of printing paper without depositing ink drops on the platen. Cyan (C), magenta (M), and yellow (Y) nozzle groups are sequentially arranged in the direction of sub-scanning A. Slots 26*m*C, 26*m*M, and 26*m*Y are provided at points disposed opposite nozzle Nos. 5–9 near the center of each nozzle group in the direction of sub-scanning. Cyan images are printed by a process in which ink drops Ip are ejected by cyan nozzle Nos. 5–9 onto the printing paper P and its peripheral area. Magenta and yellow images are printed in the same manner. Images of all colors are printed without blank spaces along the upper and lower edges of printing paper. The recorded images are superposed, making it possible to print color images without blank spaces on the printing paper. The nozzles of all groups are used to print images while leaving blank spaces on the periphery of the printing paper.

26 Claims, 20 Drawing Sheets

PRINTING UP TO PRINT MEDIUM EDGES WITHOUT PLATEN SOILING

BACKGROUND OF THE INVENTION

1. Field of the Invention

The present invention relates to a technique for recording dots on the surface of a recording medium with the aid of a dot-recording head, and more particularly to a technique for printing images up to the edges of printing paper without soiling the platen.

2. Description of the Related Art

Inkjet printers have recently become popular as computer output devices. Printing paper is supported on a platen opposite a print head and is transported on the platen such that various positions on the paper, from one end to another, are sequentially placed immediately underneath the head. A plurality of nozzles for ejecting ink drops are provided to the print head in the direction of advance of the printing paper. When the ink is ejected from the nozzles on the head, dots are sequentially recorded and images are printed on the printing paper.

To print images all the way to the edges of the printing paper with such a printer, it is necessary to put the printing paper in such a position that the edges of the printing paper are disposed underneath the print head (that is, on the platen). With such edge printing, however, the ink drops sometimes miss the edges of the printing paper (for which the drops have been originally intended) and end up depositing on the platen due to errors developing during the feeding of the printing paper, due to a shift in the impact locations of the ink drops, or the like. In such cases, the ink deposited on the platen may soil the printing paper subsequently transported over the platen.

SUMMARY OF THE INVENTION

An object of the present invention is to provide a technique that allows images to be printed up to the edges of printing paper while preventing ink drops from depositing on the platen.

Perfected in order to at least partially overcome the above-described shortcomings, the present invention envisages performing specific procedures for a dot-recording device designed to record dots on the surface of a print medium by ejecting ink drops while performing a main scan. The dot recording device comprises: a dot-recording head provided with a plurality of dot-forming element groups each of which comprises dot-forming elements for ejecting ink drops of a same color and occupies a different position in a direction of sub-scanning oriented across a direction of main scanning; a main scanning unit configured to perform main scanning by moving the dot-recording head and/or the print medium; a head driver configured to drive at least some of the dot-forming elements to form dots in the course of main scanning; a platen designed extends in a direction of main scanning while disposed opposite the dot-forming elements at least along part of a main scan pass, and that supports the print medium at a position opposite the dot-recording head; a sub-scanning unit configured to perform sub-scanning in between the main scans by moving the print medium in the direction of sub-scanning; and a control unit configured to control printing.

The platen comprises a plurality of slots that are extended in the direction of main scanning and are configured such that a width of the slot in the sub-scanning direction corresponds to not the entirety but part of a range of each dot-forming element group in the direction of sub-scanning. Such a dot-recording device allows each dot-forming element group to be used and dots to be recorded on the print medium above the slots. The dot-recording device makes it possible to print in color while preventing the platen from being soiled when ink drops miss the print medium.

Each of the dot-forming element groups may comprise a specific dot-forming element sub-group composed of specific dot-forming elements disposed within specific ranges commensurate with the width of the plurality of slots in the direction of sub-scanning. In this dot recording device, only the specific dot-forming element sub-groups are used to form dots at least in an edge portion not to have blank space in a first image print mode for printing images all the way to edges of the print medium without leaving blank spaces along an upper edge and/or a lower edge of the print medium.

Adopting this arrangement makes it possible to print images without blank spaces all the way to the upper or lower edge of a print medium by ejecting ink from dot-forming element groups disposed at different positions in a dot-recording device. As a result, color images can be printed without blank spaces all the way to the upper or lower edge of the print medium. In addition, the printing procedure in which edge portions are covered with printed images without blank spaces is carried out using specific dot-forming element sub-groups disposed opposite the slots, making it less likely that the upper surface of the platen will be soiled when ink drops miss the print medium. As used herein, the phrase "only specific dot-forming element sub-groups are used" refers to the use of at least some of the dot-forming elements constituting specific dot-forming element sub-groups, without the use of dot-forming elements other than those belonging to the specific dot-forming element sub-groups.

It is preferable that the specific dot-forming element sub-groups in the plurality of dot-forming element groups have an identical number of dot forming elements. Adopting this arrangement allows printing to be performed in an efficient manner because each color is recorded on the print medium at the same pace in the first image print mode.

At least one of the specific dot-forming element sub-groups may preferably be located in a plurality of divided locations. The platen may also be provided with a plurality of the slots that are positioned opposite the specific dot-forming element sub-group at the plurality of divided locations.

The platen preferably comprises: upstream support portions each configured to support the print medium on upstream side of each slot in the direction of main scanning, and downstream support portions each configured to support the print medium on downstream side of each slot in the direction of main scanning. Adopting this arrangement allows the print medium to be supported on the upstream support or downstream support when the medium passes above the slots. The arrangement makes it less likely that the edge portions will be caught in the slots.

Each of the specific dot-forming element sub-groups may include at least one dot-forming element disposed within a specific range near a center of each dot-forming element group in the direction of sub-scanning. Adopting this arrangement allows higher-quality printed images to be obtained in the first image print mode for a dot-recording device in which the dot-forming elements disposed closer to the center in the direction of sub-scanning tend to better approximate design values in terms of performance than do the dot-forming elements disposed closer to the edges.

Only the specific dot-forming element sub-groups may be used to form all dots on the print medium in the first image print mode. Adopting this arrangement allows dots to be recorded by performing sub-scanning in accordance with a constant pattern from beginning to end.

It is preferable that a length of each slot in the direction of main scanning is greater than a width of a print medium having a specific standard size usable in the dot recording device. It is also preferable that ink drops are ejected from dot-forming elements selected from the specific dot-forming element sub-groups into an area near a side edge portion of the print medium supported on the platen to print images without leaving blank spaces in the side edge portion. Adopting this arrangement makes it possible to form dots without blank spaces in side edge portions and makes it less likely that an ink drop that has missed the print medium will soil the upper surface of the platen.

Dots in a middle portion located between the upper and lower edges of the print medium may be recorded in the first image print mode by using the specific dot-forming elements in the specific dot-forming element sub-groups and dot-forming elements other than the specific dot-forming element subgroups; and by performing the sub-scanning in greater increments than feed increments of sub-scanning in the edge portions. Adopting this arrangement makes it possible to print images faster than when dots are recorded with specific dot-forming element sub-groups alone.

For above described printing, it is preferable that a specific one of the slots disposed in an extreme upstream section in the direction of sub-scanning is located on downstream side in relation to a central position of a dot-forming element group facing the slot in the extreme upstream section in the direction of sub-scanning. It is also preferable that a specific one of the slots disposed in an extreme downstream section in the direction of sub-scanning is located on upstream side in relation to a central position of a dot-forming element group facing the slot in the extreme downstream section in the direction of sub-scanning. Adopting this arrangement makes it possible to narrow the range in which dots must be recorded on the print medium with specific dot-forming element sub-groups alone. Accordingly the printing can be performed in shorter period.

The platen may preferably further comprise a pair of lateral slots disposed at a distance substantially equal to a width of a specific sized print medium in the direction of main scanning within a range that allows ink drops to be deposited by the plurality of dot-forming elements in the direction of sub-scanning. The dot-recording device may preferably comprise a guide configured to position the print medium in the direction of main scanning such that the specific sized print medium can be supported on the platen and two side edges of the print medium can be kept at positions above openings of the lateral slots. In such an arrangement, it is preferable that ink drops are ejected from dot-forming elements selected from the specific dot-forming element sub-groups into an area near a side edge portion of the print medium supported on the platen to print images without leaving blank spaces in the side edge portion. Adopting this arrangement allows dots to be formed without blank spaces in the side edge portions of a print medium, and makes it less likely that the upper surface of the platen will be soiled.

It is preferable that dots are formed by using specific dot-forming elements and dot-forming elements other than the specific dot-forming elements in a second image print mode for printing images leaving blank spaces along the upper and lower edges of the print medium. Adopting this arrangement allows printing to be accelerated in a second image print mode for printing images without leaving blank spaces along the upper or lower edge.

The present invention can be implemented as the following embodiments.

(1) A dot-recording device, print control device, or printing device.

(2) A dot-recording method, print control method, or printing method.

(3) A computer program for operating the device or implementing the method.

(4) A storage medium containing computer programs for operating the device or implementing the method.

(5) A data signal transmitted by a carrier wave and designed to contain a computer program for operating the device or implementing the method.

These and other objects, features, aspects, and advantages of the present invention will become more apparent from the following detailed description of the preferred embodiments with the accompanying drawings.

DESCRIPTION OF THE PREFERRED EMBODIMENTS

Embodiments of the present invention will now be described through working examples in the following sequence.

A. Overview of Embodiments
B. FIRST WORKING EXAMPLE
  B1. Device Structure
  B2. Selection of Image Print Mode
  B3. Printing
C. SECOND WORKING EXAMPLE
D. Modifications
  D1. Modification 1
  D2. Modification 2
  D3. Modification 3
  D4. Modification 4
  D5. Modification 5
  D6. Modification 6

A. Overview of Embodiments

Figure 1:
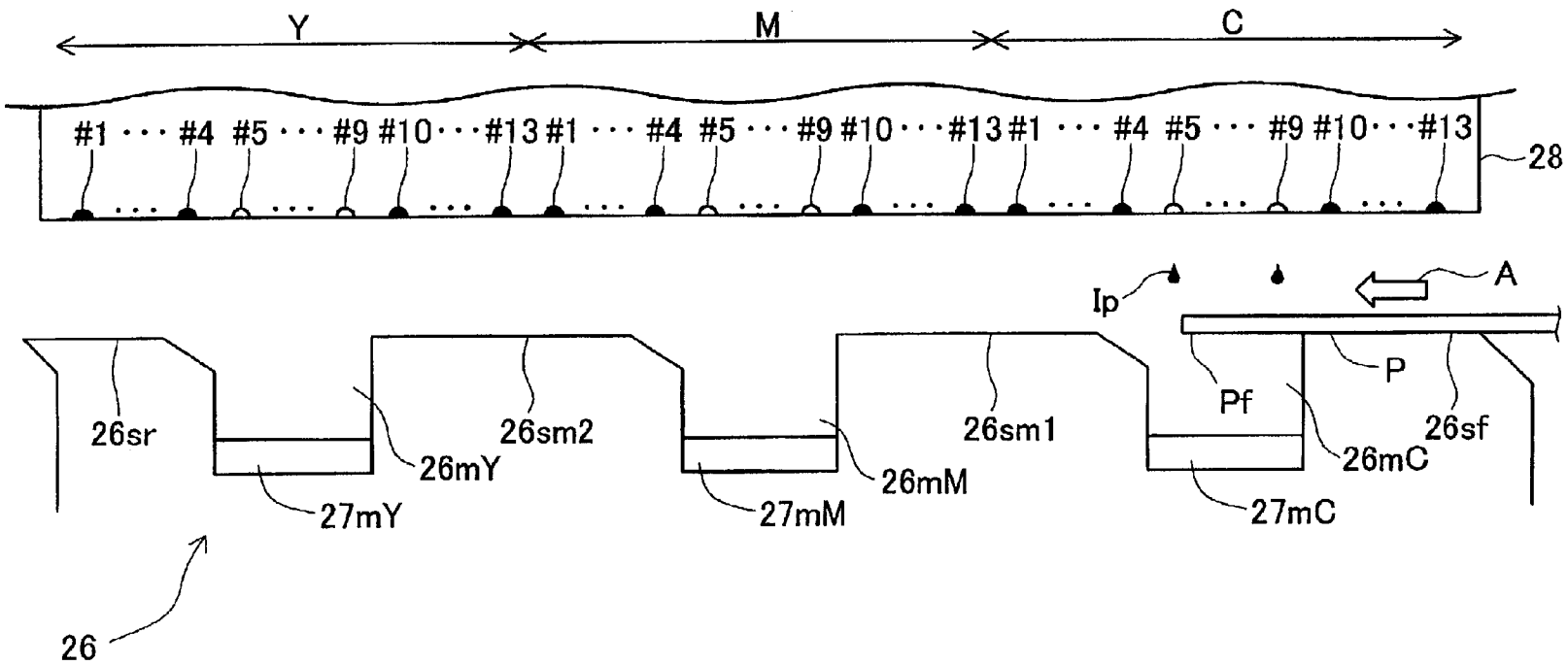
FIG. 1 is a side view depicting the structure of a print head and a platen for an ink-jet printer configured according to an embodiment of the present invention.

FIG. 1 is a side view depicting the structure of a print head and a platen for an ink-jet printer configured according to an embodiment of the present invention. The printer is provided with cyan (C), magenta (M), and yellow (Y) nozzle groups, each composed of 13 nozzles and sequentially arranged in the feed direction A of the printing paper (direction of sub-scanning). Slots, 26*m*C 26*m*M, and 26*m*Y are provided at positions opposite nozzle Nos. 5–9 of the corresponding nozzle groups. With the present printer, ink drops are ejected from the cyan (C), magenta (M) and yellow (Y) nozzles in the direction of specific positions on the printing paper. A color image is formed by superposing these images on the printing paper. In the present specification, the nozzles are identified by number.

In FIG. 1, the printing paper P is fed (sub-scanned) by an upstream paper feed roller, and the upper edge Pf thereof reaches a point above the opening of the slot 26*m*C. At this moment, ink drops Ip are ejected from cyan nozzle Nos. 5–9 on the print head 28, and the printing of a cyan image is started. Since printing is started when the upper edge Pf of the printing paper P is on the right of cyan nozzle No. 5 (to the upstream section in the direction of sub-scanning), cyan images can be printed all the way to the edge without leaving any blank spaces in the upper-edge portion Pf of the printing paper P even when the paper is fed incorrectly. In addition, the nozzles being used (nozzle Nos. 5–9) are disposed above the slot 26*m*C, so the ink drops that miss the printing paper P are prevented from depositing on supports 26*sf* and 26*sm*1 (which constitute the upper surface of the platen 26) and soiling the subsequently transported printing paper. An image is then printed on the printing paper P with cyan ink by nozzle Nos. 5–9. In FIG. 1, nozzles used during printing without leaving blank spaces in the edge portions are drawn with open semicircles while inactive nozzles are drawn with solid semicircles.

Similarly, ink drops Ip are ejected from magenta nozzle Nos. 5–9, and the printing of a magenta image is started when the upper edge Pf of the printing paper reaches a point above the opening of the slot 26*m*M. Ink drops Ip are subsequently ejected from yellow nozzle Nos. 5–9, and the printing of a yellow image is started when the upper edge Pf of the printing paper reaches a point above the opening of the slot 26*m*Y.

When the lower edge of the printing paper P is above the opening of the slot 26*m*C, ink drops Ip are ejected from cyan nozzle Nos. 5–9, and a cyan image is printed. Similarly, ink drops Ip are ejected from magenta nozzle Nos. 5–9, and a magenta image is printed in the lower-edge portion when the lower edge is above the opening of the slot 26*m*M. Ink drops Ip are ejected from yellow nozzle Nos. 5–9, and a yellow image is printed in the lower-edge portion when the lower edge is above the opening of the slot 26*m*Y. Cyan, magenta, and yellow images can thus be printed without leaving blank spaces along the upper or lower edge of the printing paper. Superposing these printed images makes it possible to form color images up to edges of the printing paper without forming blank spaces.

When images are printed while blank spaces are left along the periphery of printing paper, all the nozzles in the cyan (C), magenta (M), and yellow (Y) nozzle groups are used for such printing. Although the above description was given with reference to a case in which color images were created in three colors (cyan (C), magenta (M), and yellow (Y)), it is also possible to adopt an arrangement in which color images are printed further using black, light cyan, light magenta, and other color inks.

B. FIRST WORKING EXAMPLE

B1. Device Structure

Figure 2:
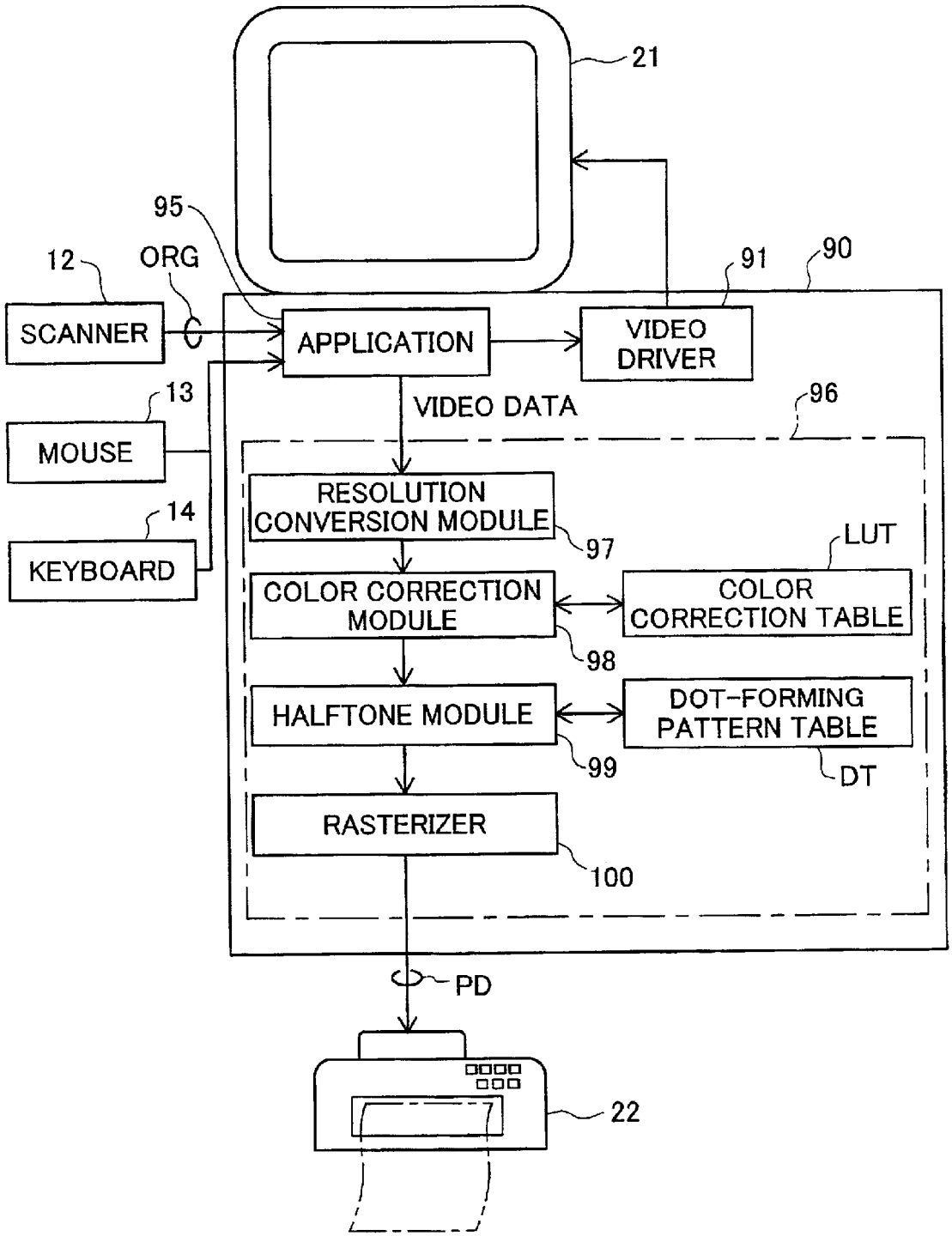
FIG. 2 is a block diagram depicting the structure of the software for the present printing device.

FIG. 2 is a block diagram depicting the structure of the software for the present printing device. In the computer 90, an application program 95 is executed within the framework of a specific operating system. The operating system contains a video driver 91 and a printer driver 96. The application program 95 for performing video retouching or the like allows color video data ORG to be read from the scanner 12 and displayed by the CRT 21 by means of the video driver 91 trough some processes. The video data ORG are in the form of primary-color video data composed of the three color components red (R), green (G), and blue (B).

When the application program 95 generates a printing command, the printer driver 96 receives video data D from the application program 95 and converts these data to a signal that can be processed by the printer 22 (in this case, into a signal containing multiple values related to the colors cyan, magenta, light cyan, light magenta, yellow, and black). The printer driver 96 comprises a resolution conversion module 97, a color correction module 98, a halftone module 99, and a rasterizer 100. A color correction table LUT and a dot-forming pattern table DT are also stored.

The role of the resolution conversion module 97 is to convert the resolution of the color video data handled by the application program 95 into a resolution that can be handled by the printer driver 96. The color correction module 98 then converts the video data for RBG into data for each of the colors (cyan (C), magenta (M), light cyan (LC), light magenta (LM), yellow (Y), and black (K)) used by the printer 22 for individual pixels while the color correction table LUT is consulted. The term "pixel" refers to a single square of an imaginary grid formed on a print medium (and occasionally extended outside the print medium) in order to define the positions in which dots are to be recorded by the deposition of ink drops.

The color-corrected data have a gray scale with 256 steps, for example. The halftone module 99 executes a halftone routine for expressing this gray scale in the printer 22 by forming dispersed dots. In the process, the dot formation patterns of the corresponding ink dots are specified while the dot-forming pattern table DT is consulted. The video data are then sorted according to the data sequence to be transferred to the printer 22 by the rasterizer 100, and are outputted as final print data PD.

Figure 3:
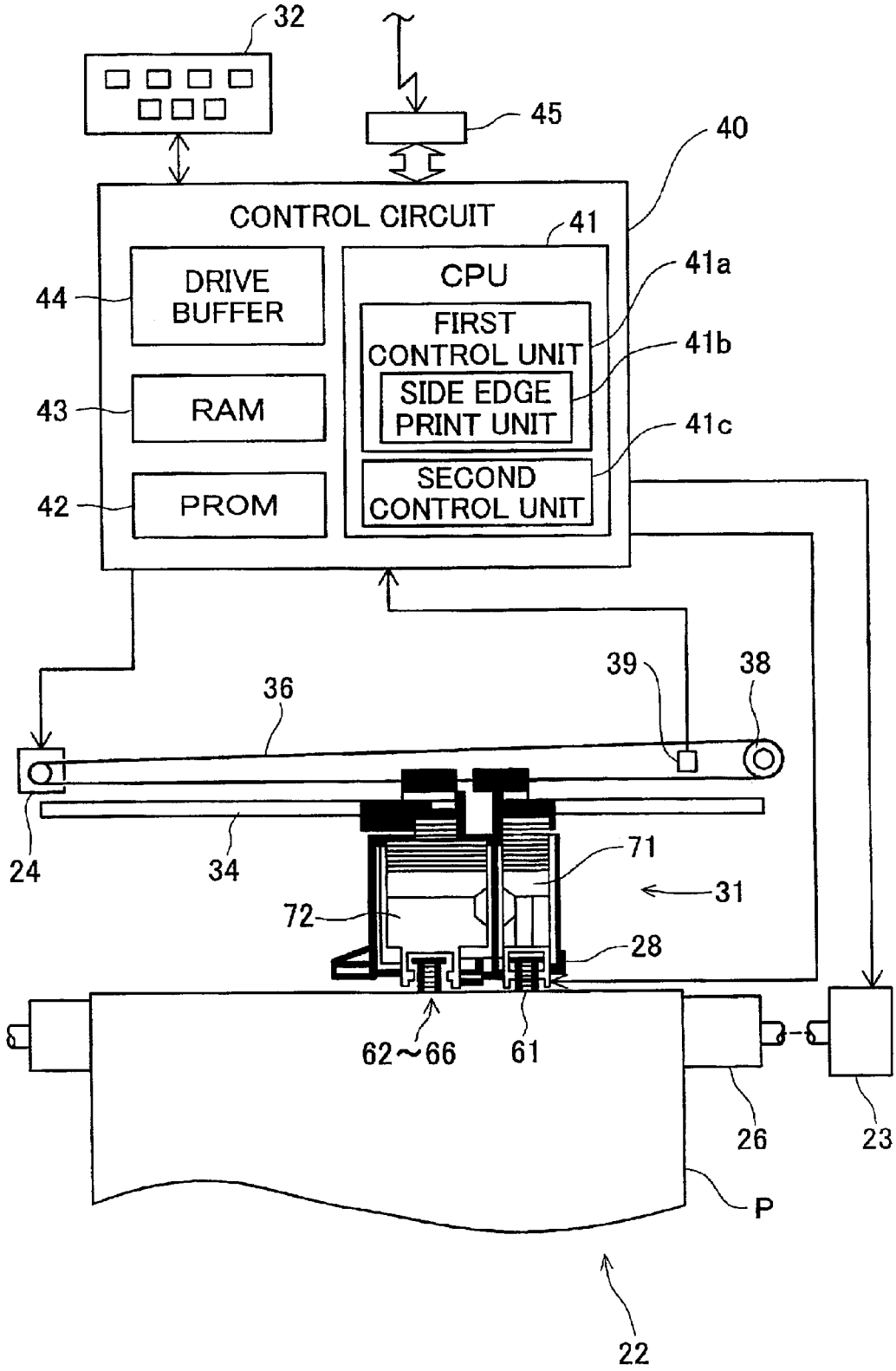
FIG. 3 is a diagram depicting the structure of the mechanical portion of the present printing device.

The overall structure of the printer 22 will now be described with reference to FIG. 3. As can be seen in the drawing, the printer 22 comprises a mechanism for transporting paper P with the aid of a paper feed motor 23; a mechanism for reciprocating a carriage 31 in a direction perpendicular to the transport direction of printing paper P with the aid of a carriage motor 24; a mechanism for actuating the print head 28 mounted on the carriage 31 and ejecting the ink to form ink dots; and a control circuit 40 for exchanging signals between the paper feed motor 23, the carriage motor 24, the print head 28, and a control panel 32.

The control circuit 40 contains the following units in addition to CPU 41, PROM 42, and RAM 43: a PC interface 45 for exchanging data with the computer 90, a drive buffer 44 for outputting the ON and OFF signals of the ink jet to the ink-ejecting heads 61–66. These elements and circuits are connected together by a bus. The control circuit 40 receives the dot data processed by the computer 90, temporarily stores them in the RAM 43, and outputs the results to the drive buffer 44 according to specific timing. The CPU 41 functions as a first control unit 41*a* and second control unit 41*c* by executing the computer programs stored in the PROM 42.

The mechanism for reciprocating the carriage 31 comprises a sliding shaft 34 mounted perpendicular to the transport direction of the printing paper P and designed to slidably support the carriage 31; a pulley 38 for extending an endless drive belt 36 between the carriage 31 and the carriage motor 24 and; a position sensor 39 for sensing the original position of the carriage 31.

The carriage 31 can support a cartridge 71 for black ink (K) and a color-ink cartridge 72 containing inks of the following five colors: cyan (C), light cyan (LC), magenta (M), light magenta (LM), and yellow (Y). A total of six ink-ejecting heads 61 to 66 are provided to the print head 28 in the bottom portion of the carriage 31. Mounting the cartridge 71 for the black (K) ink and the cartridge 72 for the color inks on the carriage 31 allows the ink to be fed from the ink cartridges to the ejection heads 61 to 66.

Figure 4:
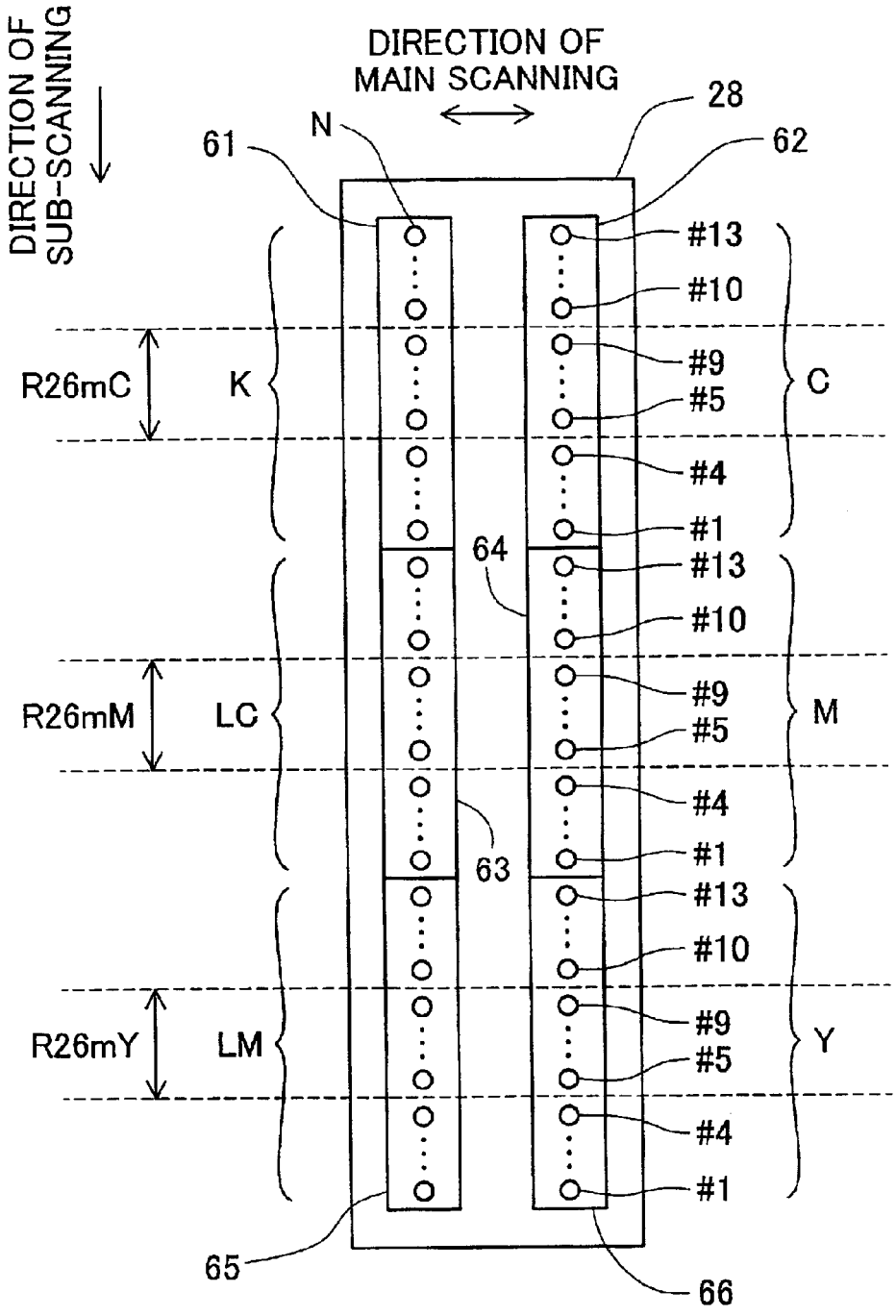
FIG. 4 is a diagram depicting the arrangement of the ink-jet nozzles N in the print head 28.

FIG. 4 is a diagram depicting the arrangement of the ink-jet nozzles N in the print head 28. These nozzles form six nozzle arrays for ejecting inks of various colors (black (K), cyan (C), light cyan (LC), magenta (M), light magenta (LM), and yellow (Y)), and the 13 nozzles of each array form a single row at a constant pitch k. The six nozzle arrays form two rows in the direction of sub-scanning. One row comprises, in order from upstream in the direction of sub-scanning, cyan (C), magenta (M), and yellow (Y); and the other row comprises black (K), light cyan (LC), and light magenta (LM).

Each of the nozzle arrays in the present working example is provided to a different head selected from ejection heads 61–66, although providing these arrays to the same ejection heads is also a viable option. To take such cases into account, "print head" is used in the present specification to designate structural elements that include nozzle arrays of all colors. "Nozzle pitch" is a value equal to the number of raster lines (that is, pixels) accommodated by the interval between the nozzles on the print heads in the direction of sub-scanning. "Raster line" denotes a row of pixels aligned in the direction of main scanning and occasionally referred to as a main scan line.

Rows of nozzles (nozzle arrays) for ejecting inks of each of these colors correspond to the dot-forming elements referred to in the claims. The nozzles of each nozzle row that are disposed within the ranges R26mC, R26 mM, and R26mY shown by the broken lines in FIG. 4 correspond to the specific dot-forming elements referred to in the claims. The ranges R26mC, R26mM, and R26mY shown by the broken lines in FIG. 4 are specific ranges selected from the ranges for accommodating each nozzle array and disposed in the vicinity of the center in the direction of sub-scanning. The platen 26 that faces the print head 28 is provided with slots 26*m*C, 26*m*M, and 26*m*Y (see FIG. 1) in the areas corresponding to the ranges R26mC, R26mM, and R26mY, respectively. In other words, the specific dot-forming elements in each of these color nozzle rows are disposed at positions that face the slots 26*m*C, 26*m*M, and 26*m*Y.

In this case, the specific ranges R26mC, R26mM, and R26mY in the vicinity of the center can be devoid of nozzles along the two edges in the direction of sub-scanning. In preferred practice, these ranges may contain nozzles that are disposed in the center in the direction of sub-scanning and constitute less than half the nozzle arrays provided in the direction of sub-scanning. The ranges may also contain nozzles that are disposed in the center in the direction of sub-scanning and constitute less than a third of the nozzle arrays provided in the direction of sub-scanning. When the nozzles disposed in the center in the direction of sub-scanning cannot be limited to a single nozzle and are composed of two nozzles that are equidistant from the center, a specific range in the vicinity of the center may contain both these nozzles.

The first working example was described with reference to a case in which the print head 28 was provided with black (K), light cyan (LC), and light magenta (LM) nozzle rows as well as the cyan (C), magenta A), and yellow (Y) nozzle rows. The black (K), light cyan (LC), and light magenta (LM) nozzle rows are arranged parallel to the cyan (C), magenta (M), and yellow (Y) nozzle rows in the manner shown in FIG. 4. Accordingly, the side view of this arrangement is the same as shown in FIG. 1. For this reason, FIG. 1, which was used above to describe a case in which images were printed in three colors, can also be used in the description of the first working example.

Figure 5:
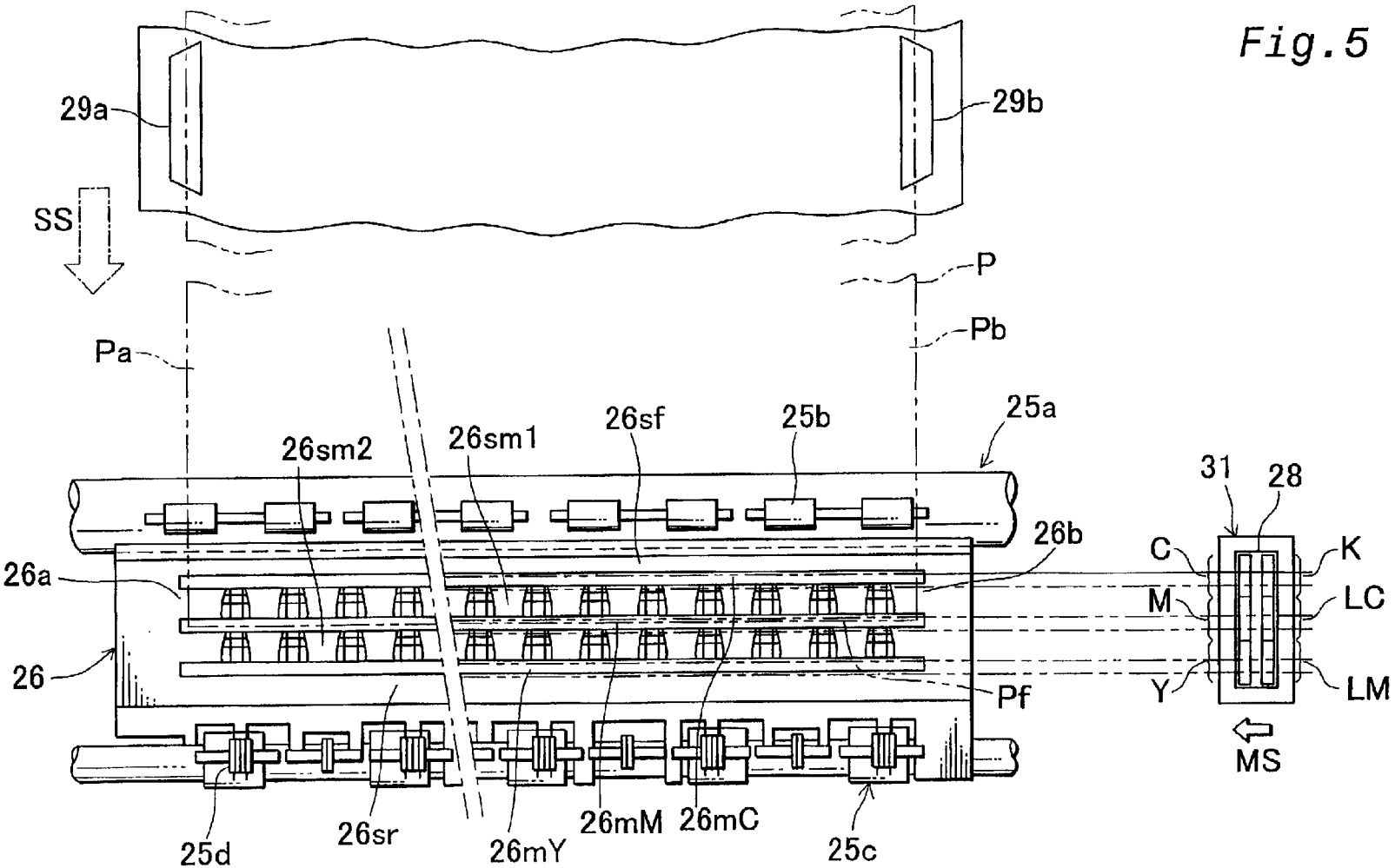
FIG. 5 is a plan view depicting the periphery of the platen 26.

FIG. 5 is a plan view depicting the periphery of the platen 26. The length of the platen 26 in the direction of sub-scanning is greater than the maximum width of the printing paper P that can be accommodated by the printer 22. Upstream paper feed rollers 25*a* and 25*b* are provided upstream of the platen 26. Whereas the upstream paper feed roller 25*a* is a single drive roller, the upstream paper feed roller 25*b* comprises a plurality of freely rotating small rollers. Downstream paper feed rollers 25*c* and 25*d* are also provided downstream of the platen. The downstream paper feed roller 25*c* comprises a plurality of rollers on a drive shaft, and the downstream paper feed roller 25*d* comprises a plurality of freely rotating small rollers. Slots parallel to the axis of rotation are formed in the external peripheral surface of the downstream paper feed roller 25*d*. Specifically, the downstream paper feed roller 25*d* has radial teeth (portions between slots) in the external peripheral surface thereof and appears to be shaped as a gear when viewed along the axis of rotation thereof. The downstream paper feed roller 25*d* is commonly referred to as a milled roller and is designed to press the printing paper P against the platen 26. The downstream paper feed roller 25*c* and upstream paper feed roller 25*a* rotate synchronously at the same peripheral speed.

The platen 26 is provided with slots 26*m*C, 26*m*M, and 26*m*Y, which extend in a straight line in the direction of sub-scanning. The positions of these slots in the direction of sub-scanning are opposite nozzle Nos. 5–9 in the nozzle arrays on the print head 28, as described above. The upper surface of the platen on the upstream side of the slot 26*m*C is referred to as an upstream support 26*sf*, and the upper surface of the platen on the downstream side of the slot 26*m*Y is referred to as a downstream support 26*sr*. The upper surface of the platen between the slots 26*m*C and 26 mM is referred to as an intermediate support 26*sm*1, and the upper surface of the platen between the slots 26*m*M and 26*m*Y is referred to as an intermediate support 26*sm*2.

The length of each of the slots 26*m*C, 26*m*M, and 26*m*Y in the direction of main scanning is greater than the maximum width of the printing paper P that can be accommodated by the printer 22. Absorbent members 27*m*C, 27*m*M, and 27*m*Y for receiving and absorbing ink drops Ip are provided to the bottoms of the corresponding slots (see FIG. 1).

The printing paper P is held by the upstream paper feed rollers 25*a* and 25*b* and the downstream paper feed rollers 25*c* and 25*d*, and an intermediate portion thereof is supported by the upper surface of the platen 26 while disposed opposite the rows of nozzles in the print head 28. The paper is fed in the direction of sub-scanning by the upstream paper feed rollers 25*a* and 25*b* and the downstream paper feed rollers 25*c* and 25*d*. The print head 28 records images by ejecting ink drops while moving back and forth in the direction of main scanning across the platen 26.

When sub-scanned by both the upstream paper feed rollers 25*a* and 25*b* and the downstream paper feed rollers 25*c* and 25*d*, the printing paper P passes over the slots 26*m*C, 26*m*M, and 26*m*Y while supported by the upstream support 26*sf*, intermediate supports 26*sm*1 and 26*sm*2, and downstream support 26*sr*. When the front edge Pf of the printing paper P passes over the slot 26*m*C, the rear portion of the printing paper P is supported by the upstream support 26*sf*, making it unlikely that the front edge Pf will be caught in the slot 26*m*C. In addition, the front portion of the printing paper P is supported by the intermediate support 26*sm*1 when the rear edge Pr of the printing paper P passes over the slot 26*m*C, making it unlikely that the rear edge Pr will be caught in the slot 26*m*C. Similarly, each slot has supports 26*sm*1, 26*sm*2, and 26*sr* upstream and downstream thereof, making it less likely that the printing paper will be caught in these slots when passing over the slot openings.

The upstream support 26*sf* for the slot 26*m*C corresponds to the upstream support portion referred to in the claims, and the intermediate support 26*sm*1 corresponds to the downstream support portion referred to in the claims. The intermediate support 26*sm*1 for the slot 26*m*M corresponds to the upstream support portion referred to in the claims, and the intermediate support 26*sm*2 corresponds to the downstream support portion referred to in the claims. The intermediate support 26*sm*2 for the slot 26*m*Y corresponds to the upstream support portion referred to in the claims, and the downstream support 26*sr* corresponds to the downstream support portion referred to in the claims.

B2. Selection of Image Print Mode

Figure 6:
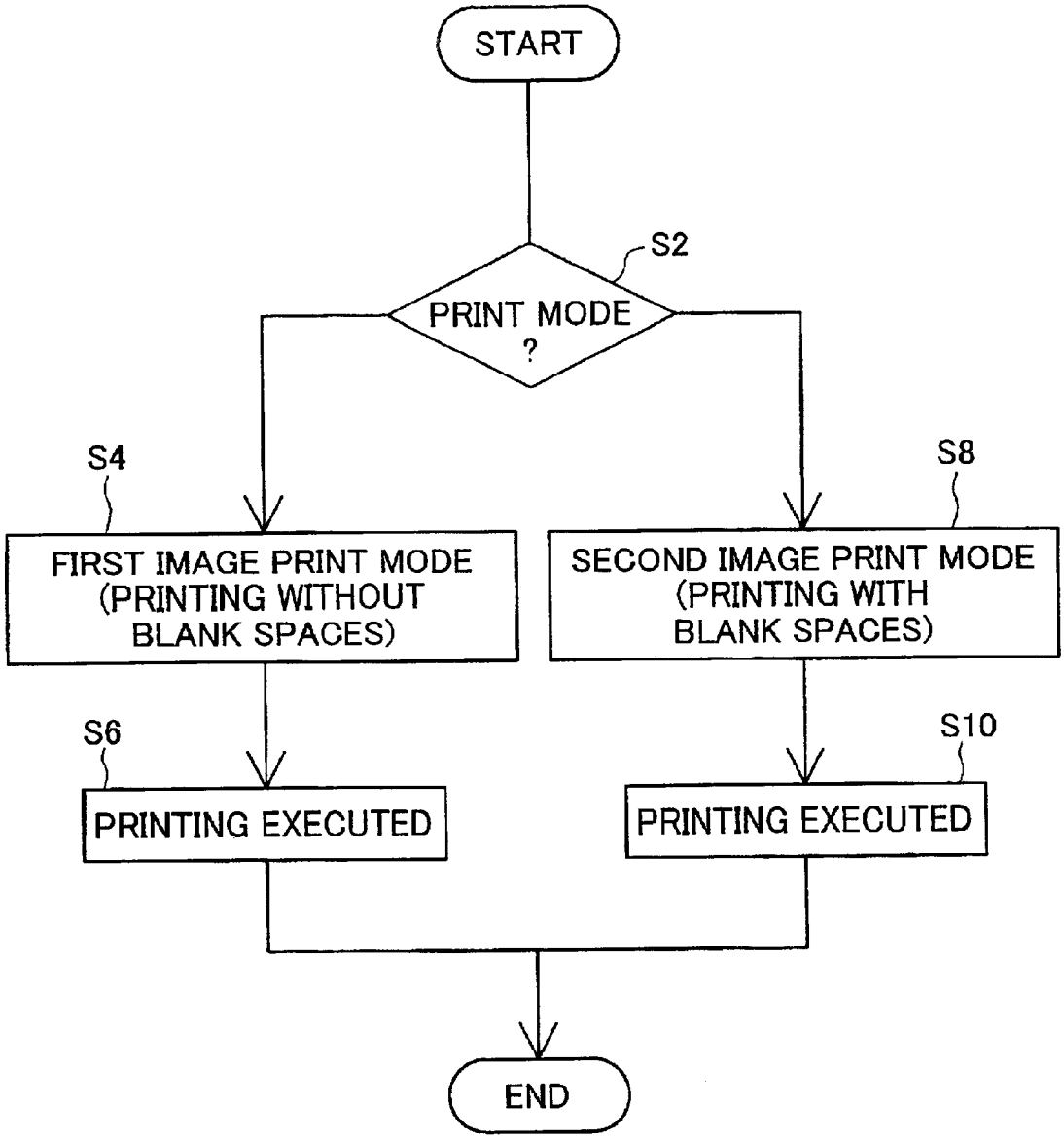
FIG. 6 is a flowchart depicting a printing sequence.

FIG. 6 is a flowchart depicting a printing sequence. The printer 22 has a first image print mode for printing images without leaving blank spaces along the periphery (that is, along the four edges) of the printing paper P, and a second image print mode for printing images while leaving blank spaces along the periphery of the printing paper P. The second image print mode allows the printer 22 to print images with the aid of all the nozzles, and the first image print mode allows images to be printed using solely nozzle Nos. 5–9. (These nozzles face the slots.)

To print, the user first selects the first or second image print mode, as shown in FIG. 6. The selection is input to the computer 90 via the mouse 13 or the keyboard 14 (See FIG. 2). When the first image print mode is selected in the step S2, the computer 90 processes the video data D along the first image print mode in the step S4 and performs the printing along the first image print mode in the step 6. On the contrary, when the second image print mode is selected in the step S2, the computer 90 processes the video data D in the step S8 and performs the printing in the step 10 along the second image print mode respectively.

Figure 7:
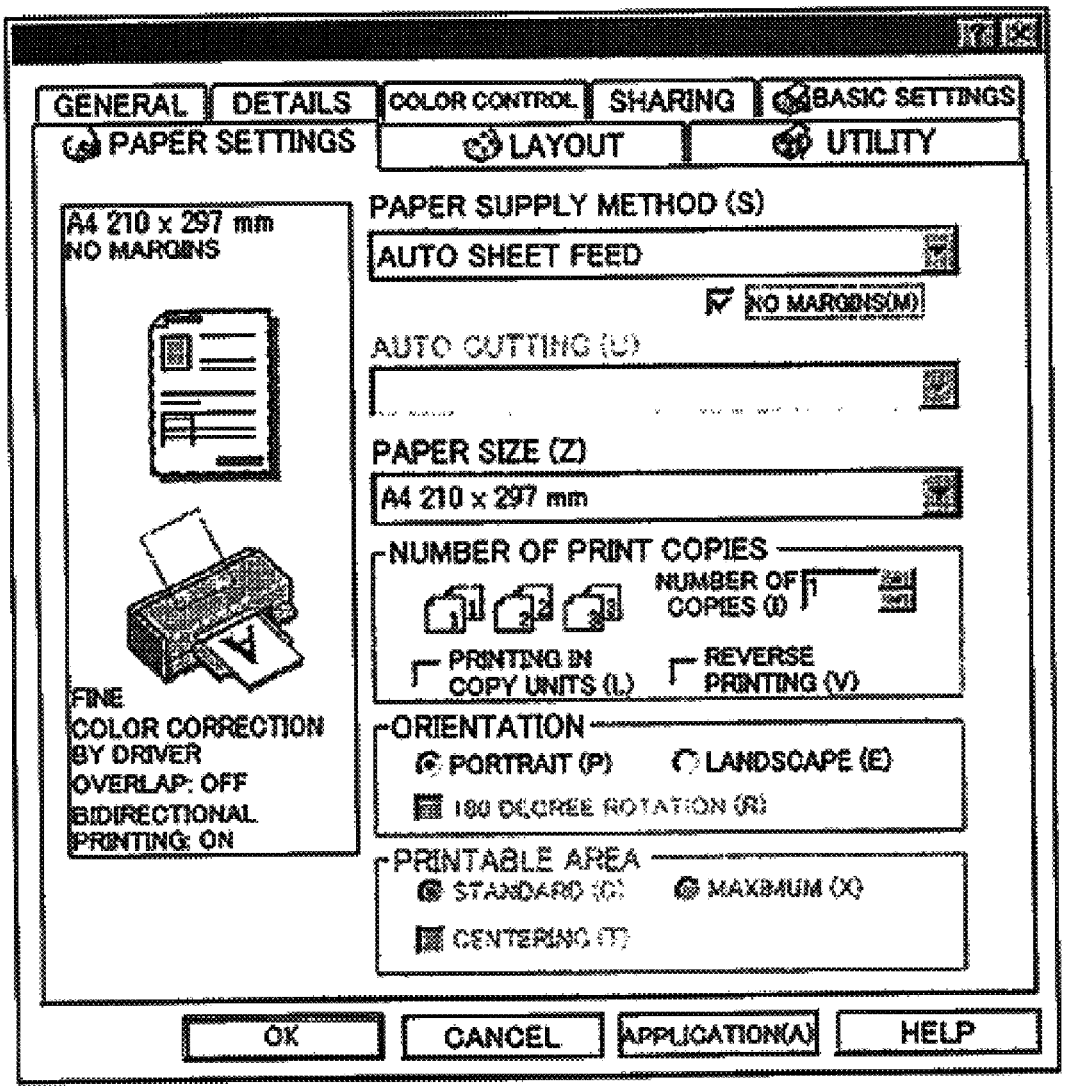
FIG. 7 is a diagram depicting a selection screen for selecting the first or second image print mode by the user.

FIG. 7 is a diagram depicting a selection screen for selecting the first or second image print mode by the user. The printer driver 96 executed by the CPU 41 during printing displays on the CRT 21 a selection screen such as the one shown in FIG. 7 (see FIGS. 1 and 2). The user selects the "paper setting" tab in the upper part of the screen with a mouse 13 and checks the box "no margins (M) on any side" in the upper right corner, thereby presenting the computer 90 with the information that the first image print mode has been selected. If the user leaves the box "no margins (M) on any side" unchecked, the computer 90 is presented with the information that the second image print mode has been selected. The user can also dispense with the use of the mouse 13 and enter information about the selection of the image print mode for the printer driver 96 with the aid of the keyboard or other input device connected to the computer 90.

The printer driver 96 prepares print data PD in accordance with the selected image print mode. The first image print mode is executed by the first control unit 41*a* (see FIG. 3); the second image print mode, by the second control unit 41*c*.

Figure 8:
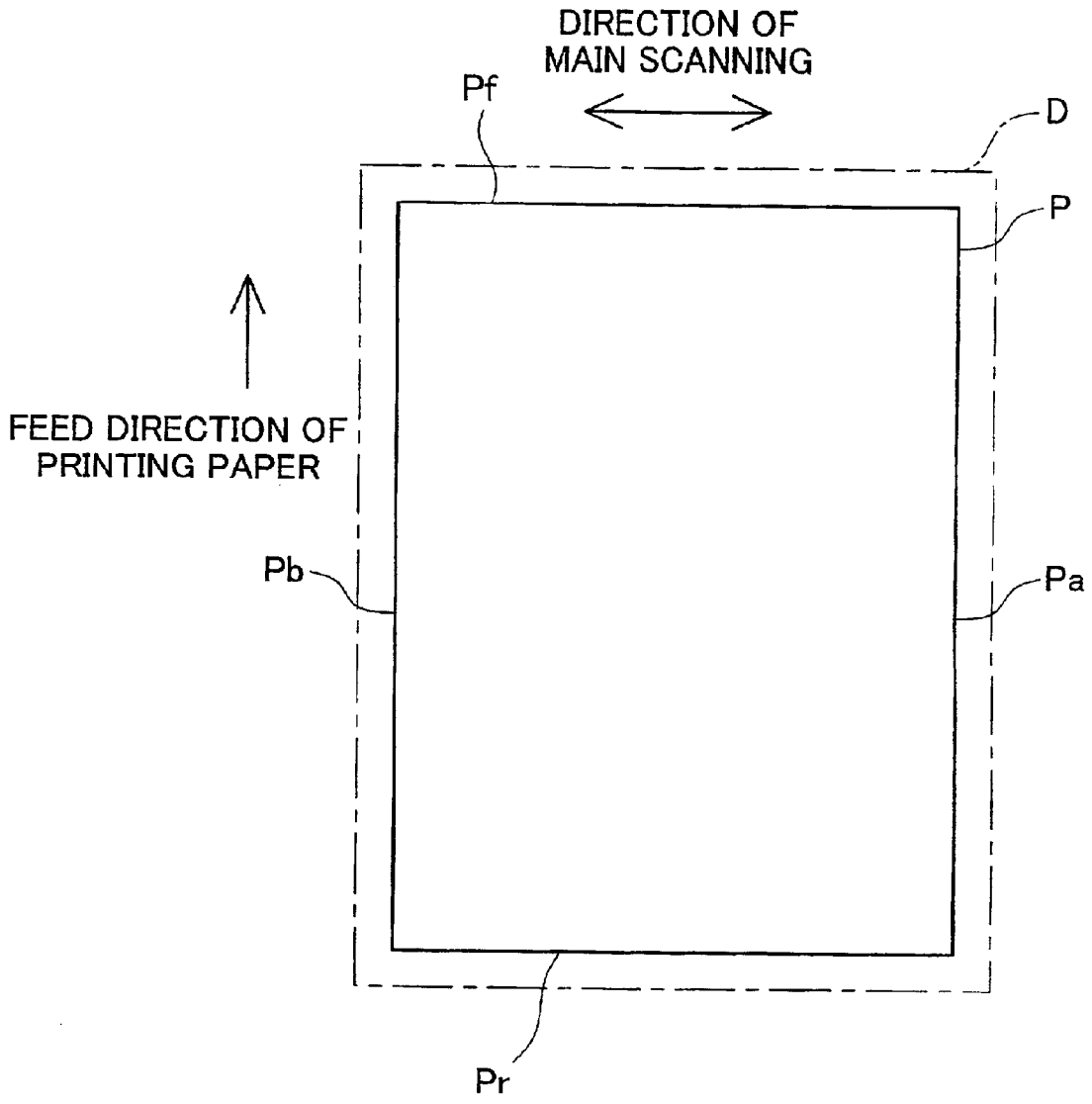
FIG. 8 is a plan view depicting the relation between video data D and printing paper P in the first image print mode.

FIG. 8 is a plan view depicting the relation between video data D and printing paper P in the first image print mode. In the first image print mode, the video data D are provided up to the area outside the printing paper P beyond the upper edge Pf of the printing paper P. The video data D are provided in the same manner up to the areas outside the printing paper P beyond the lower edge Pr, left-hand edge Pa, and right-hand edge Pb of the printing paper P. In the first image print mode, therefore, the relation between the recording area of the video data D and the arrangement of the printing paper P assumes the configuration shown in FIG. 8. In the first image print mode, images are printed without blank spaces all the way to the edges of printing paper on the basis of the video data D. The terms "left" and "right" used with respect to the left-hand edge Pa and right-hand edge Pb correspond to the terms "left" and "right" used with respect to the printer 22, so the terms "left-hand edge Pa" and "right-hand edge Ph" are in a reverse relation to the left and right sides of the printing paper P in FIG. 8.

In the present specification, the terms "upper edge (portion)" and "lower edge (portion)" are used to designate the edges of the printing paper P corresponding to the top and bottom of the video data recorded on the printing paper P. The terms "front edge (portion)" and "rear edge (portion)" are used to designate the edges of the printing paper P corresponding to the direction in which the printing paper P is advanced during sub-scanning in the printer 22. In the present specification, the term "upper edge (portion)" corresponds to the front edge (portion) of the printing paper P, and the term "lower edge (portion)" corresponds to the rear edge (portion).

Figure 9:
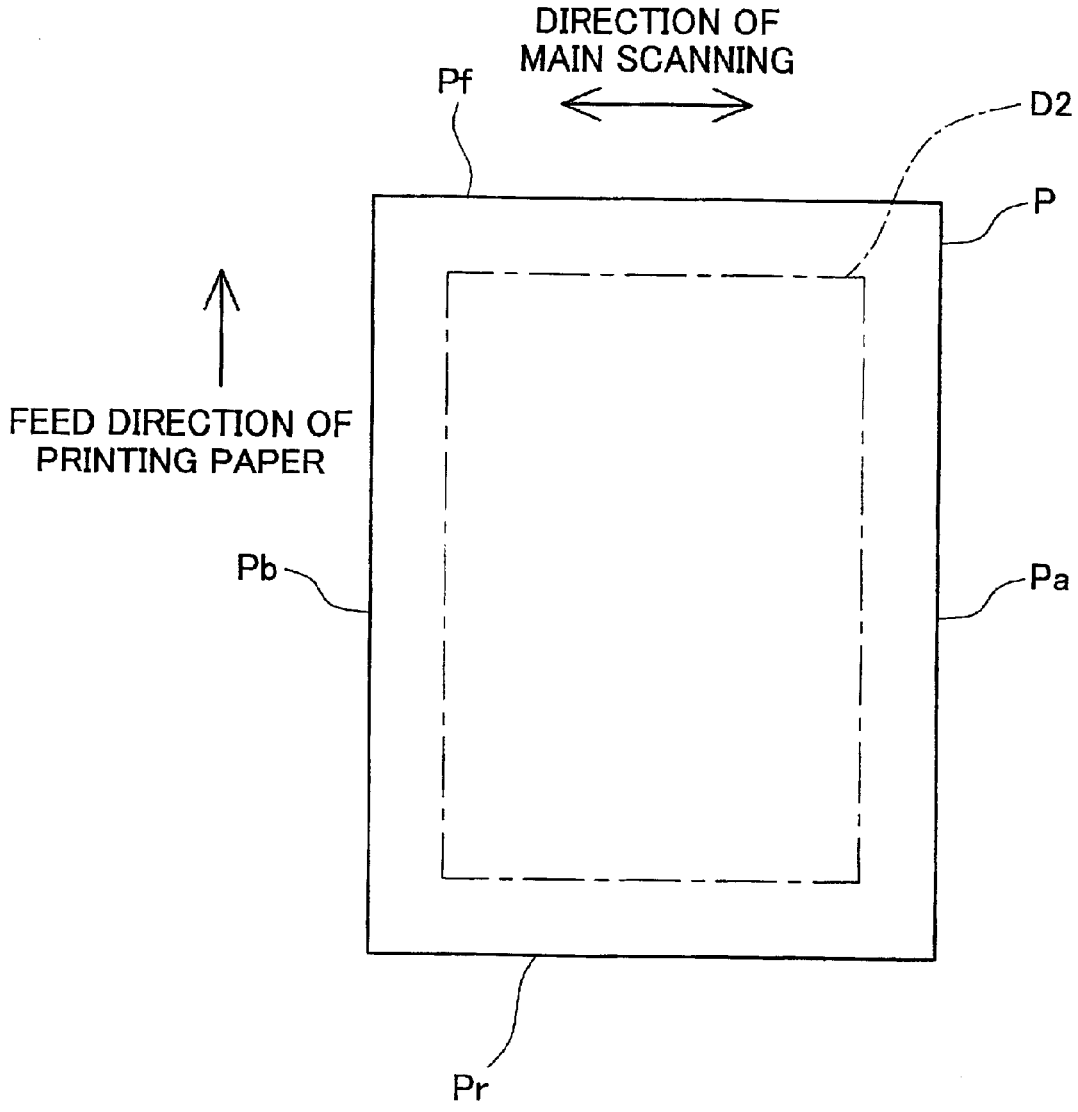
FIG. 9 is a plan view depicting the relation between video data D2 and printing paper P in the second image print mode.

FIG. 9 is a plan view depicting the relation between video data D2 and printing paper P in the second image print mode. In this mode, the video data D2 are used to form images in an area smaller than the printing paper P, as shown in FIG. 9. The images are printed on the printing paper P while blank spaces are left on the four sides.

B3. Printing

Different sub-scanning patterns are used during actual printing in accordance with the first and second image print modes. The manner in which sub-scanning is performed during actual printing will now be described separately for the first and second image print modes.

(1) Sub-scanning in First Image Print Mode

Figure 10:
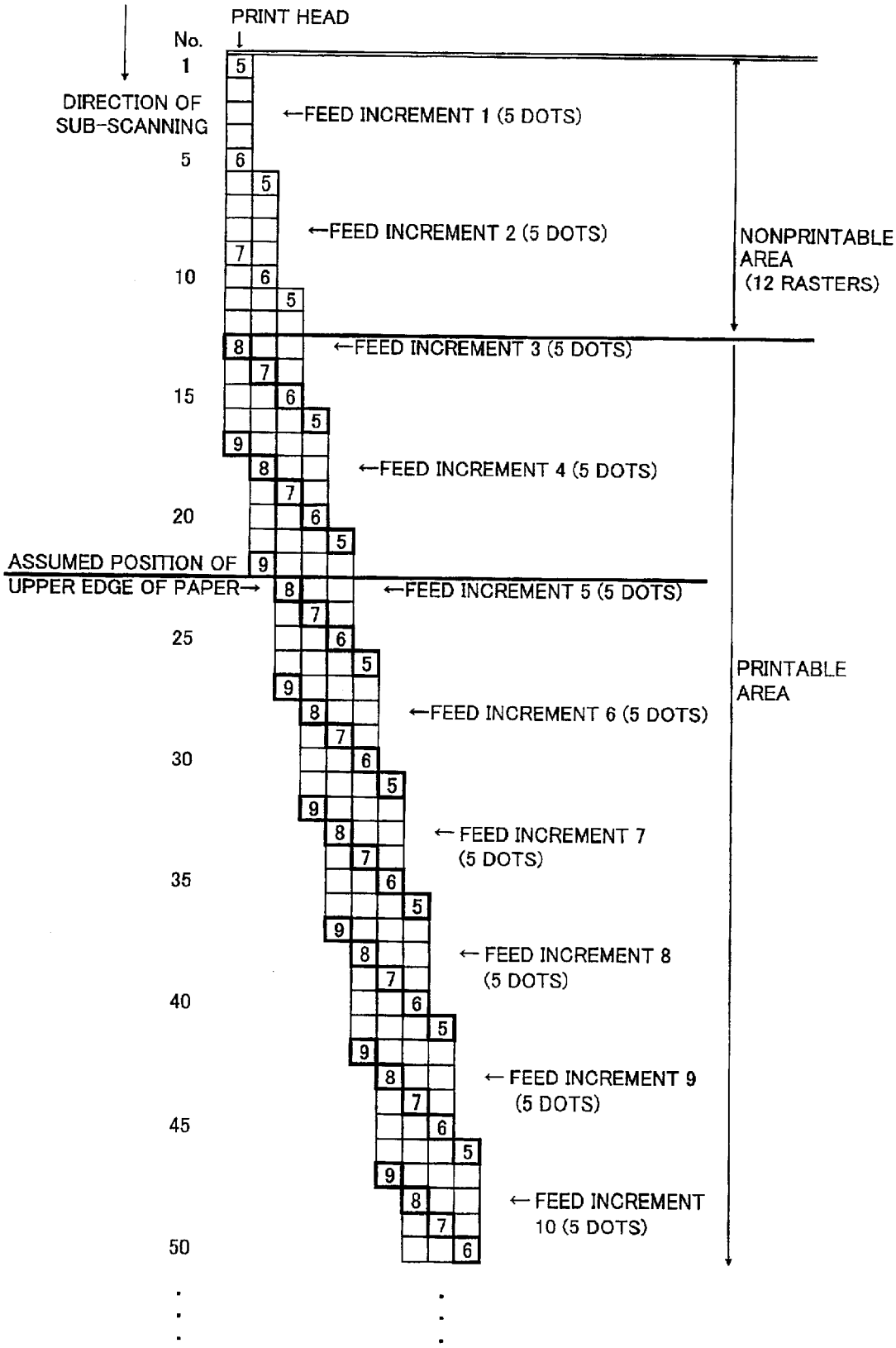
FIG. 10 is a diagram depicting the manner in which raster lines are recorded by particular nozzles in the first image print mode.

FIG. 10 is a diagram depicting the manner in which raster lines are recorded by particular nozzles in the first image print mode. For the sake of simplicity, the description will be limited to the cyan nozzle row, which is one of the plurality of nozzle rows available. It is assumed that the nozzles are spaced apart at intervals corresponding to three raster lines. The nozzles used in the first image print mode are the five nozzles (nozzle Nos. 5–9) in the center of the section containing 13 nozzles.

In FIG. 10, a single vertical column of squares represents the print head 28. The numerals 5–9 in each square indicate nozzle numbers. In FIG. 10, the print head 28, which is transported over time in relative fashion in the direction of sub-scanning, is shown moving in sequence from left to right. In the first image print mode, five-dot regular feeding is performed, as shown in FIG. 10. As a result, each raster line is composed of dots recorded by the corresponding nozzle.

As a unit of feed increment in the direction of sub-scanning, the term "dot" designates a single-dot pitch corresponding to the printing resolution in the direction of sub-scanning, and this dot is also equal to the pitch of raster lines. In FIG. 10, the nozzles within bold boxes are used for recording dots on raster lines.

In FIG. 10, the nozzles never once pass over the second to fourth, seventh, eighth, or 12th raster lines (as counted from the uppermost tier). In other words, no dots can be recorded in these raster lines. With regard to the present working example, none of the raster lines extending from the uppermost tier to the 12th line can be used to record images. In other words, with regard to the present working example, of all the raster lines in which dots can be recorded by the nozzles of the print head 28, it is only the 13th and greater raster lines (as counted from the upstream end in the direction of sub-scanning) that can be used to record images. The area of raster lines that can be used to record images is referred to as a printable area. The area of raster lines that cannot be used to record images is referred to as a nonprintable area. In FIG. 10, the numbers attached in order from the top to the raster lines in which dots can be recorded by the nozzles of the print head 28 are indicated on the left side of the drawing. The same applies hereinbelow to the drawings illustrating the recording of dots during an upper-edge routine.

Figure 11:
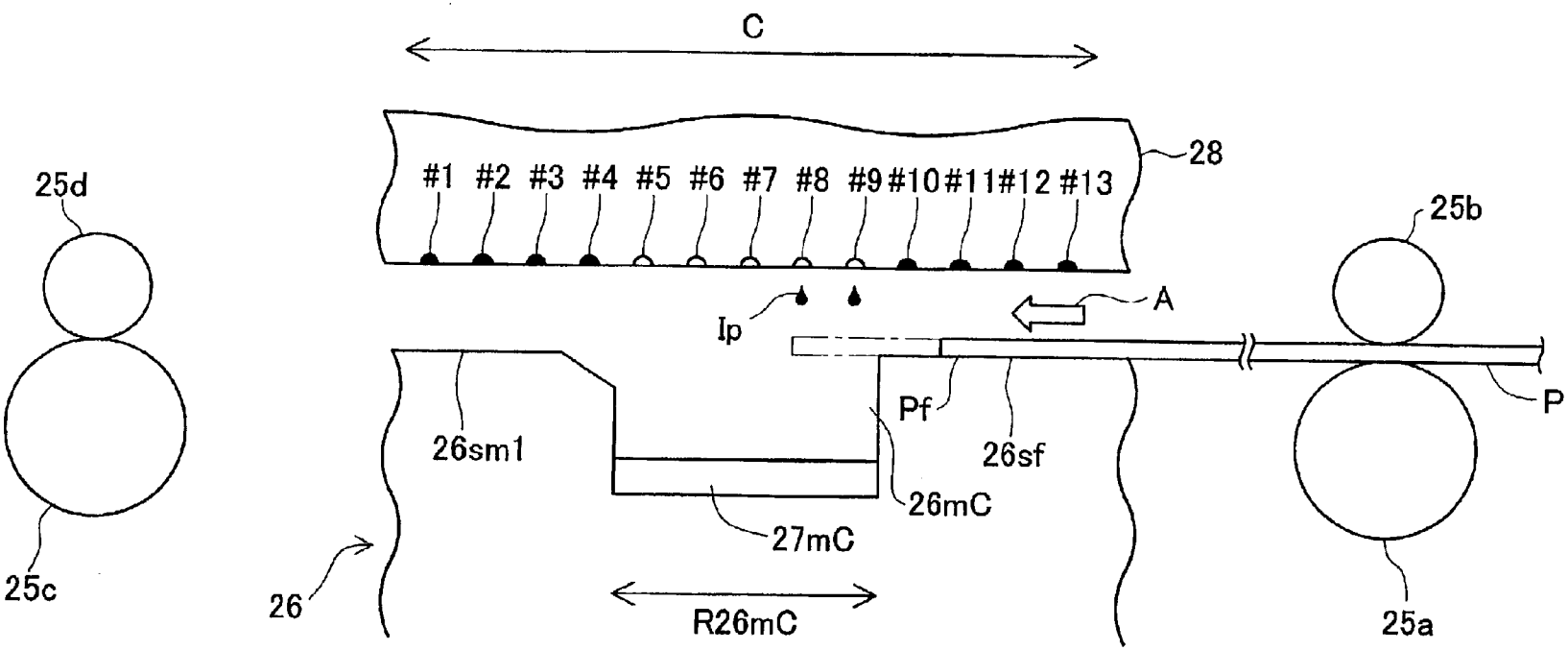
FIG. 11 is a side view depicting the relation between the print head 28 and printing paper P at the start of printing.

FIG. 11 is a diagram depicting the relation between the print head 28 and printing paper P at the start of printing. It is assumed herein that the slot 26*m*C extends over a range R26mC that starts at a forward position corresponding to two raster lines (as counted from cyan nozzle No. 5 on the print head 28) and ends at a rearward position corresponding to two raster lines (as counted from cyan nozzle No. 9). Consequently, the ink drops Ip from nozzle Nos. 5–9 are prevented from depositing on the upper surface of the platen 26 (upstream support 26*sf*, intermediate support 26*sm*1) even when the ink drops are ejected from the nozzles in the absence of printing paper.

At the start of printing, the upper edge Pf of the printing paper P is in a position corresponding to the 23rd raster line (as counted from the upstream edge in the direction of sub-scanning). This raster line is one of the raster lines on which dots can be recorded by the nozzles provided to the print head 28, as shown in FIG. 10. In other words, the upper edge of the printing paper P is located at a distance of six raster lines upstream of nozzle No. 9 (two raster lines upstream of nozzle No. 10; see FIG. 11). The result is that if printing is started in this condition, it is expected that the uppermost raster line (raster line No. 13 from the top in FIG. 10) in the printable area will be recorded by nozzle No. 8, and the fifth raster line (raster line No. 17 from the top in FIG. 10) will be recorded by nozzle No. 9, but the printing paper P has not yet reached a point underneath these nozzles. Consequently, the ink drops Ip ejected by nozzle Nos. 8 and 9 fall directly into the slot 26*m*C, provided the printing paper P is accurately fed by the upstream paper feed rollers 25*a* and 25*b*. The same applies to the recording of raster lines extending from the top of the printable area to the tenth raster line (up to raster line No. 22 from the top in FIG. 10).

There may, however, be cases in which the upper edge of the printing paper P reaches a raster line that lies further than No. 11 from the top of the printable area (assumed position of the upper edge; raster line No. 23 from the top in FIG. 10) if the printing paper P has for some reason been fed over a greater distance than the intended feed increment. The present working example allows ink drops Ip to be ejected for these raster lines in such cases as well, making it possible to record images along the upper edge of the printing paper P and preventing blank spaces from being formed. In other words, feeding the printing paper P over a greater distance than the intended feed increment still fails to result in the formation of blank spaces along the upper edge of the printing paper P as long as such excessive feeding does not exceed ten raster lines (position shown by the dashed line in FIG. 11).

Conversely, a situation might be envisaged in which for some reason the printing paper P is fed over a distance less than the intended feed increment. In such cases, the printing paper is absent from its intended position, and the ink drops Ip end up depositing on the underlying structure. In the first image print mode, however, each raster line is recorded with nozzle Nos. 5–9, as shown in FIG. 11. The slot 26*m*C is disposed underneath these nozzles. Consequently, ink drops Ip that have missed the printing paper P will be accepted by the slot 26*m*C and absorbed by the absorbent member 27*m*C. It is therefore possible to prevent situations in which ink drops Ip deposit on the upper surface of the platen 26 and soil the subsequently fed printing paper. In other words, the present working H example makes it possible to prevent situations in which ink drops Ip deposit on the upper surface (upstream support 26*sf*, intermediate support 26*sm*1) of the platen 26 and soil the subsequently fed printing paper P even when the upper edge Pf of the printing paper P is disposed behind an assumed position of the upper edge at the start of printing.

When images are printed at the lower edge of the printing paper P, dots are formed in the same manner on the printing paper P by nozzle Nos. 5–9 above the slot 26*m*C on the basis of the video data D (see FIG. 8) provided for an area beyond the lower edge. It is therefore possible to print images at the lower edge of the printing paper P without soiling the platen 26 or forming blank spaces.

Figure 12:
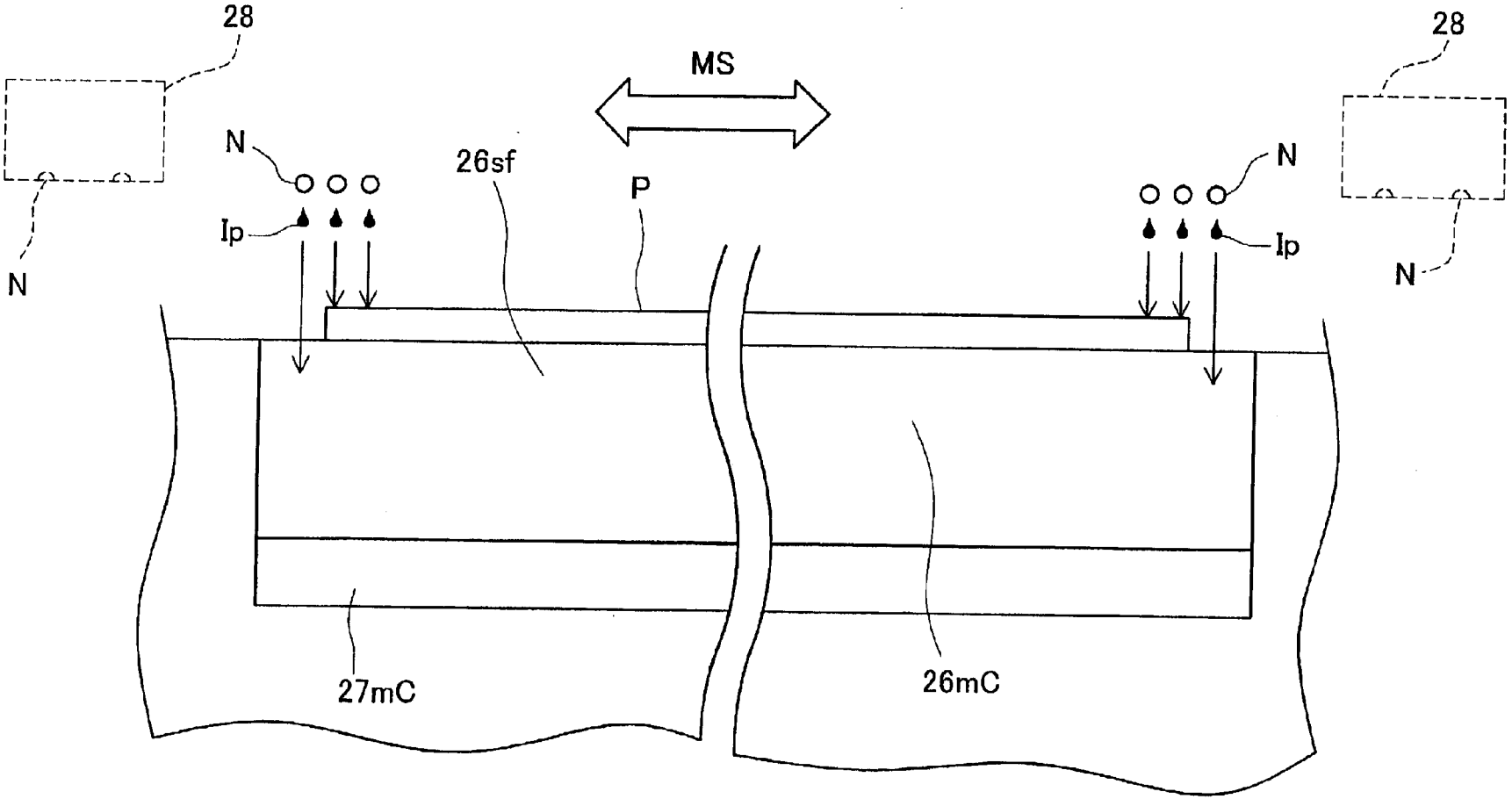
FIG. 12 is a diagram depicting printing in the left and right edge portions of the printing paper P in the first image print mode, as viewed in the upstream direction from inside the slot 26*m*C.

FIG. 12 is a diagram depicting printing in the left and right edge portions of the printing paper P in the first image print mode, as viewed in the upstream direction from inside the slot 26*m*C. The length of each of the slots 26*m*C, 26*m*M, and 26*m*Y is greater than the width of the printing paper P in the direction of main scanning, as shown in FIGS. 12 and 5. In addition, the printing paper P is fed after being positioned by guides 29*a* and 29*b* (see FIG. 5) in the direction of main scanning substantially in the center of the slots 26*m*C, 26*m*M and 26*m*Y. As a result, the printing paper P is positioned and fed within the range defined by each slot in the direction of main scanning. Dots are formed on the printing paper P by the nozzles (Nos. 5–9) above the slots on the basis of the video data D (see FIG. 8) provided for an area beyond the left and right edges. In the process, ink drops are ejected and dots recorded when the nozzles are disposed opposite the side edge portions of the printing paper P and when disposed avobe the two edge portions of each slot 26*m*C and in the areas outside the printing paper P face each other, as shown in FIG. 12. Images can therefore be printed along the left and right edges of the printing paper P without soiling the platen 26 or leaving blank spaces. Images are printed in the side edge portions of printing paper in this manner with the aid of the side edge print unit 41*b* (see FIG. 3) inside the first control unit 41*a*.

Printing is carried out in the same manner by other nozzle arrays. Specifically, the first image print mode entails printing images by using solely nozzle Nos. 5–9, which are disposed opposite a slot and are selected from nozzle Nos. 1–13 in each nozzle array. The row of black nozzles (K) is aligned with the row of cyan nozzles (C) in the direction of main scanning, allowing ink drops to be ejected in the main scanning in the same manner as with the cyan nozzle row (C) shown in FIGS. 1 and 4. In addition, the magenta nozzle row (M) and light-cyan nozzle row (LC) are disposed downstream from the cyan nozzle row (C) in the direction of sub-scanning, so printing is started and completed behind the cyan nozzle row (C). Furthermore, the yellow nozzle row (Y) and light-magenta nozzle row (LM) are disposed downstream from the magenta nozzle row (M) and light-cyan nozzle row (LC) in the direction of sub-scanning, so printing is started and completed behind the magenta nozzle row (M) and light-cyan nozzle row (LC).

In the first image print mode, images are printed in the direction of sub-scanning solely by the nozzles above a slot. During a main scan, ink drops are ejected and images printed in the side edge portions of the printing paper in the direction of main scanning when the nozzles are above the slot. It is thus possible to print images all the way to the edges of the printing paper without soiling the platen.

The above-described effect can be achieved in the same manner in cases in which the print medium is oriented incorrectly on the platen, and the lines defining the edge portions thereof are inclined relative to the direction of main scanning. The same applies to situations in which the print medium is sub-scanned correctly but the shape of the print medium is trapezoid and the lines defining the edge portions are not parallel in the direction of main scanning, or the print medium has edge portions whose shape is other than rectilinear. The upper surface of the platen can also be prevented from being soiled in cases in which some of the ink drops are allowed to pass through the print medium such that the print medium is partially perforated or has a reticulated structure. Allowing the ink to dry before it passes through the slot, soiling of the upper platen surface can also be prevented when ink drops reach all the way to the other side of the print medium after being deposited thereon.

The user can print images without any blank spaces all the way to the edges of such specific print media by specifying the type of print medium (which is determined by size, shape, material, or the like) and indicating that images are to be printed without blank spaces all the way to the edge portions. The user can specify the type of print medium by selecting one of a group of available choices or by arbitrarily setting one of several possible parameters (size, shape, material, and the like).

In the first working example, the same number of nozzles is used in each nozzle row in the first image print mode, making it possible to feed the medium at a constant rate without employing redundant main scans, and to record dots in an efficient manner.

(2) Sub-scanning in Second Image Print Mode

For the sake of simplicity, the description will be limited to the cyan nozzle row, which is one of the plurality of nozzle rows available. All the nozzles that make up a cyan nozzle array (Nos. 1–13) are used in the second image print mode. As used herein, the phrase "all nozzles are used" means that any nozzle can be used as needed. Consequently, some nozzles might not be used in some cases, depending on the data related to the images to be printed.

Figure 13:
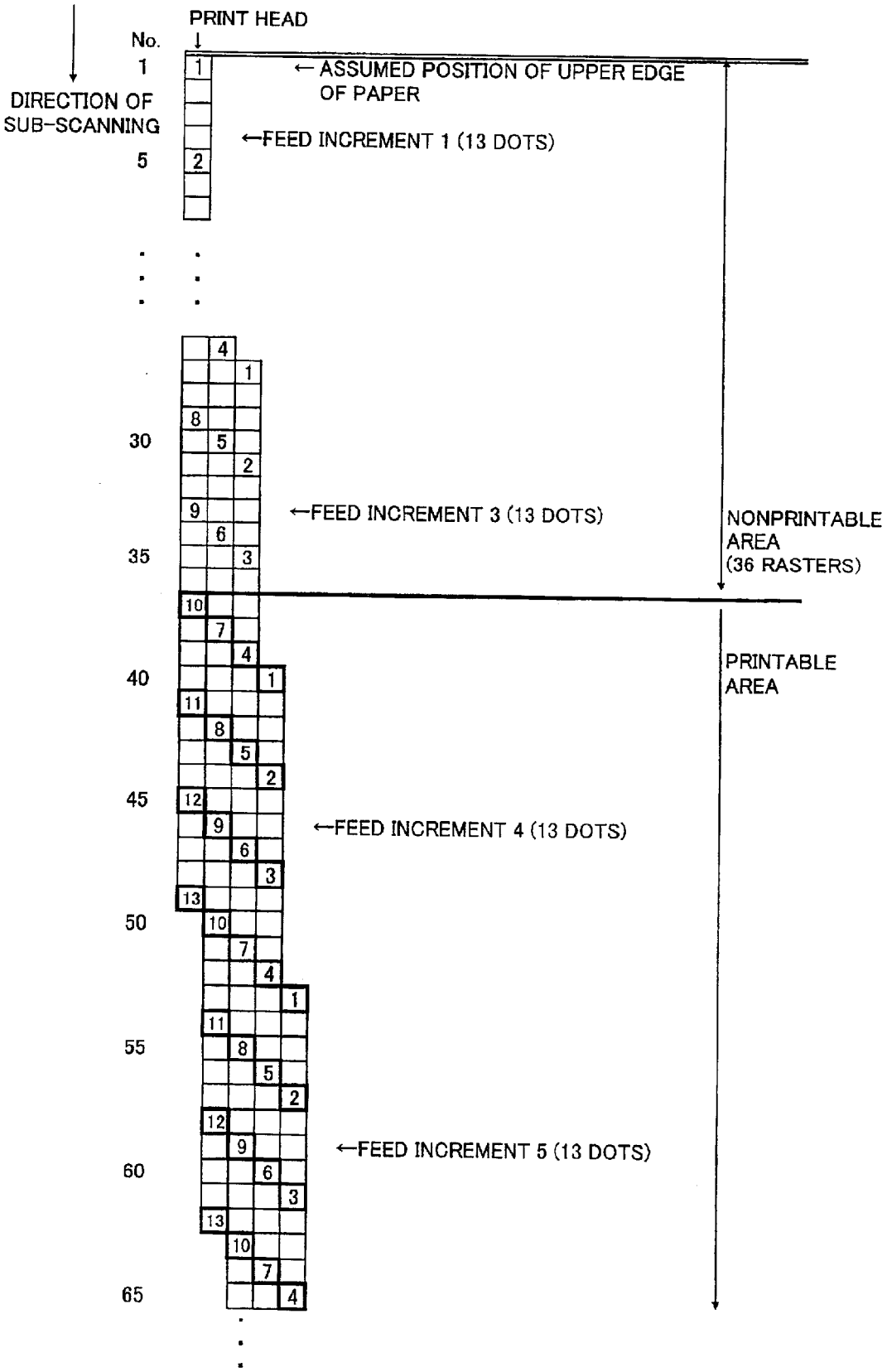
FIG. 13 is a diagram depicting the manner in which raster lines are recorded by particular nozzles in the second image print mode.

FIG. 13 is a diagram depicting the manner in which raster lines are recorded by particular nozzles in the second image print mode. In the second image print mode, 13-dot regular feeding is performed, as shown in FIG. 13. As a result, each raster line is composed of dots recorded by a single nozzle. In the second image print mode, nonprintable areas that are wider than in the case of the first image print mode are established along the upper and lower edges of the printing paper P. For example, the nonprintable area on the side of the upper edge in FIG. 10 extends over 12 raster lines from the upper edge, whereas the nonprintable area in FIG. 13 extends over 36 raster lines. The area extending over 36 raster lines contains a blank space along the upper edge of the printing paper P when the position of the uppermost raster line on which dots can still be formed by the print head coincides with the assumed position of the upper edge of the printing paper P. In the second image print mode, the nozzles used to form dots are not limited to nozzle Nos. 5–9 above the slot 26*m*C. However, the second image print mode (in which images are printed while blank spaces are left in the edge portions of the printing paper P) is still an effective mode of operation because ink drops are unlikely to be ejected to the outside beyond the blank spaces on the printing paper P. Another feature of the second image print mode is that because all the nozzles (Nos. 1–13) are involved, faster printing can be achieved than in the case of the first image print mode, in which printing is accomplished using a limited number of nozzles.

C. Second Working Example

Figure 14:
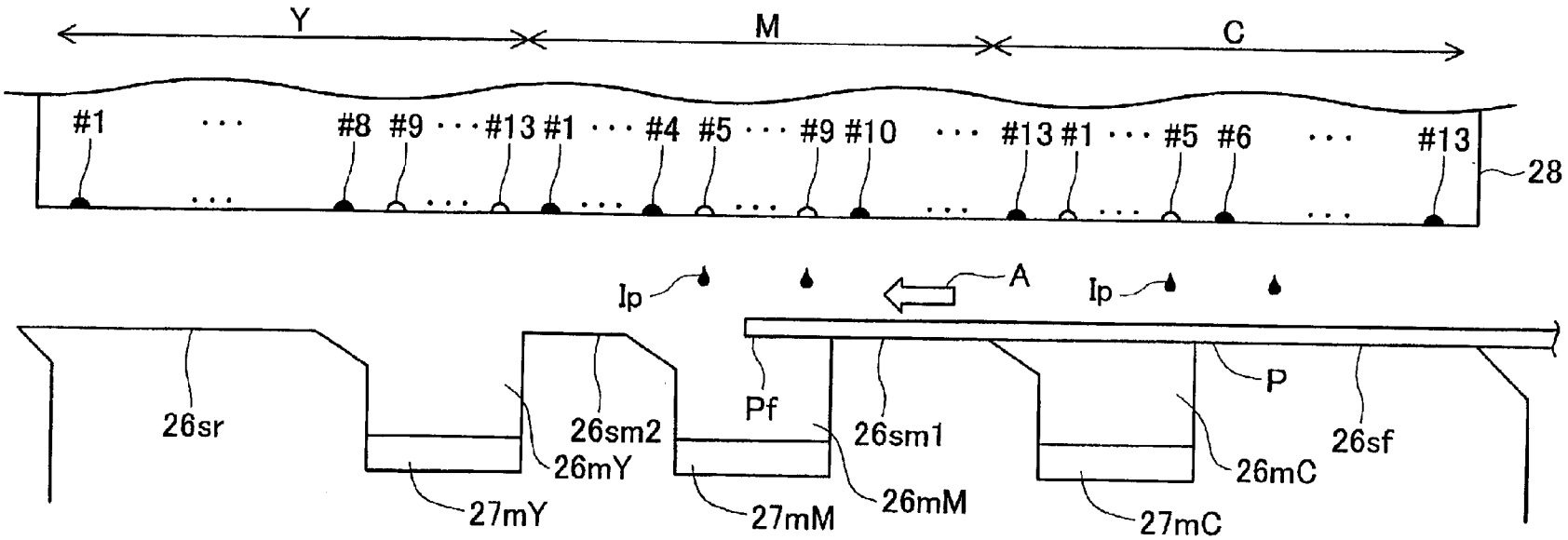
FIG. 14 is a side view depicting the relation between the print head 28 and the slots 26*m*C, 26*m*M, and 26*m*Y according to a second working example.

FIG. 14 is a side view depicting the relation between the print head 28 and the slots 26*m*C, 26*m*M, and 26*m*Y according to a second working example. The slot 26*m*M is disposed opposite nozzle Nos. 5–9 in the magenta nozzle row in the same manner as in the first working example, but the slot 26*m*C is disposed opposite nozzle Nos. 1–5 in the cyan nozzle row. The slot 26*m*Y is disposed opposite nozzle Nos. 9–13 in the yellow nozzle row. In other words, the following nozzles are disposed opposite the slots: nozzle Nos. 1–5 in the cyan and black nozzle rows, nozzle Nos. 5–9 in the magenta and light-cyan nozzle rows, and nozzle Nos. 9–13 in the yellow and light-magenta nozzle rows.

Specifically, the slot 26$m$C, which is located in the extreme upstream section in the direction of sub-scanning, is positioned downstream of the central position occupied the nozzle rows C and K (which are disposed opposite the slot 26$m$C in the direction of sub-scanning). The slot 26$m$Y, which is located in the extreme downstream section in the direction of sub-scanning, is positioned upstream of the central position occupied by nozzle rows Y and LM (which are disposed opposite the slot 27$m$Y in the direction of sub-scanning). Each nozzle row contains the same number of slot-facing nozzles.

Figure 15:
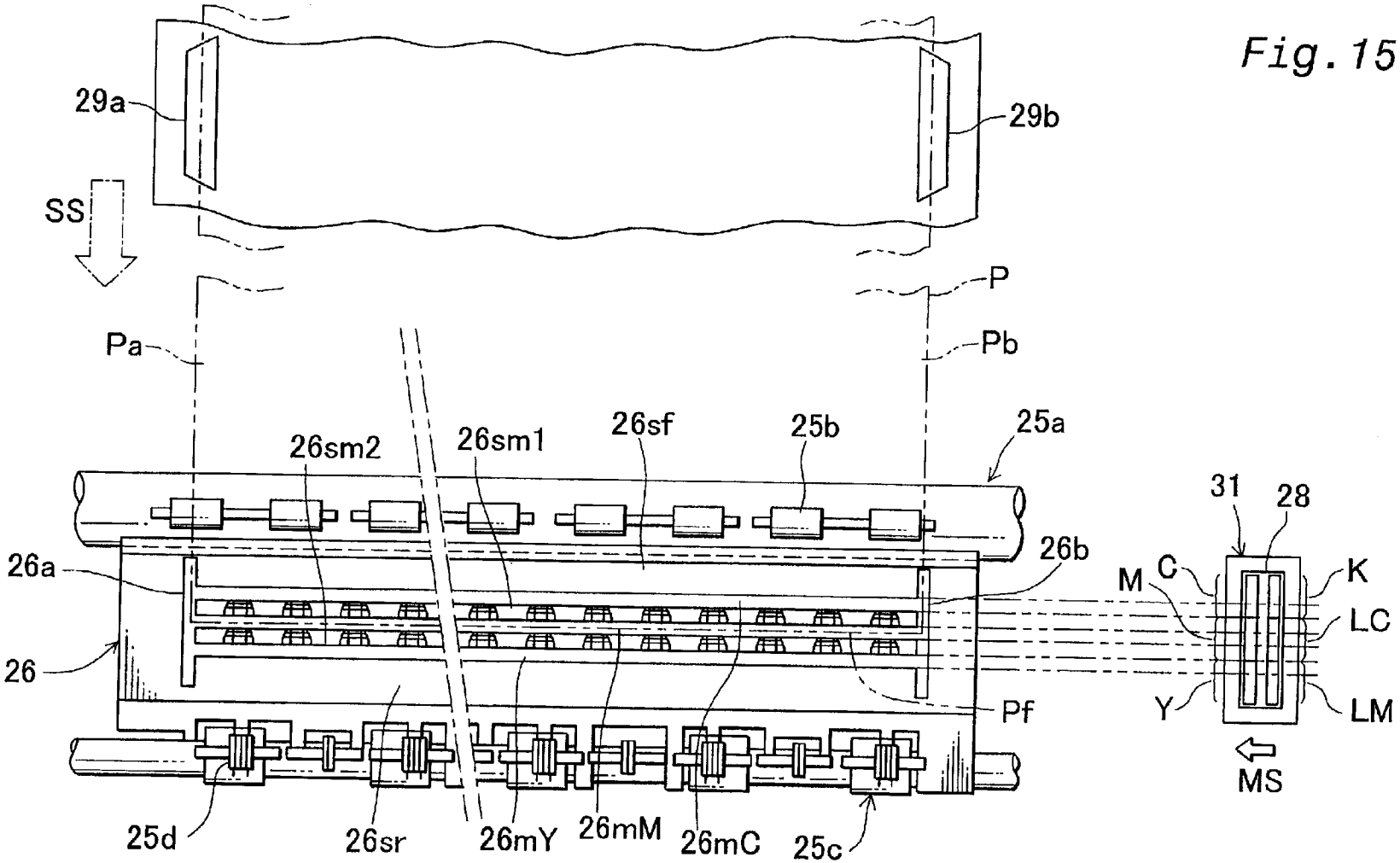
FIG. 15 is a plan view depicting the periphery of a platen 26 for the printer of the second working example.

FIG. 15 is a plan view depicting the periphery of a platen 26 for the printer of the second working example. The platen 26 is equipped with a left slot 26$a$ and right slot 26$b$ that extend in the direction of sub-scanning at positions occupied by the two corresponding edges of the slots 26$m$C, 26$m$M, and 26$m$Y. The left slot 26$a$ and right slot 26$b$ extend from a point downstream of the position occupied by nozzle No. 1 in the yellow and light-magenta nozzle rows to a point upstream of the position occupied by nozzle No. 13 in the cyan and black nozzle rows. Specifically, the left slot 26$a$ and right slot 26$b$ extend in the direction of sub-scanning over a range greater than the range occupied by the ink drops deposited by all the nozzle rows on the print head.

The left slot 26$a$ and right slot 26$b$ are arranged such that the distance between the center lines thereof (in the direction of main scanning) brings the width of the printing paper P that can be recorded with the printer 22 in agreement with the maximum width of the printing paper P in the direction of main scanning. The left slot 26$a$ and right slot 26$b$ may be designed such that one of the side edge portions (Pa) of the printing paper P in the direction of main scanning is brought to a point above the left slot 26$a$, and the other side edge portion (Pb) is brought to a point above the right slot 26$b$ when a sheet of printing paper P with the maximum possible width printable by the printer 22 is brought to a specific position of main scanning by guides 29$a$ and 29$b$. Consequently, situations in which both side edges of the printing paper P are kept inside or outside with respect to the center lines of the left slot 26$a$ and right slot 26$b$ can be established in addition to situations in which both side edges of the printing paper P are above the center lines of the left slot 26$a$ and right slot 26$b$ when the printing paper occupies a given position. The bottom portions of the left slot 26$a$ and right slot 26$b$ are also fitted with absorbent members. Other features of this structure are the same as those of the printer pertaining to the first working example.

Figure 16:
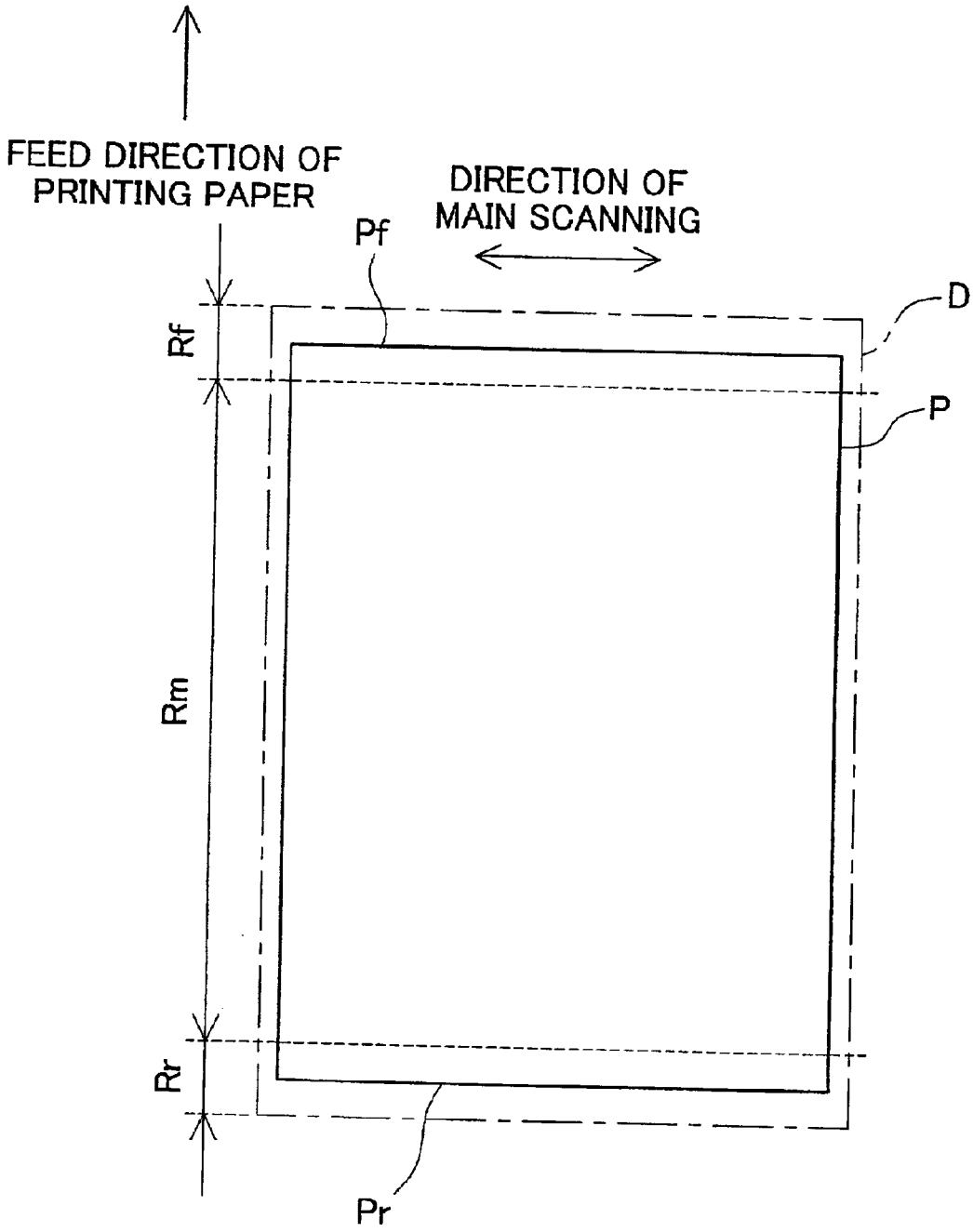
FIG. 16 is a plan view depicting regions Rf and Rr for recording dots by ejecting ink drops from slot-facing nozzles alone, and a region Rm for recording dots by ejecting ink drops from all the nozzles.

FIG. 16 is a plan view depicting regions Rf and Rr for recording dots by ejecting ink drops from slot-facing nozzles alone, and a region Rm for recording dots by ejecting ink drops from all the nozzles. In the second working example, only the nozzles that face their corresponding slots are used to record dots in the region Rf in the vicinity of the upper edge Pf of the printing paper P and in the region Rr in the vicinity of the lower upper edge Pr (see FIG. 10) with five-dot regular feeding in accordance with the first image print mode. However, all the nozzles are used to record dots in the region Rm in the middle portion of the printing paper P with 13-dot regular feeding (see FIG. 13).

Specifically, nozzle Nos. 1–5 in the cyan and black nozzle rows start ejecting ink drops when the front edge Pf of the printing paper P assumes a position above the upstream slot 26$m$C. Nozzle Nos. 5–9 in the magenta and light-cyan nozzle rows then start ejecting ink drops when the front edge Pf reaches a point above the slot 26$m$M, and nozzle Nos. 9–13 in the yellow and light-magenta nozzle rows then start ejecting ink drops when the front edge Pf reaches a point above the slot 26$m$Y. Sub-scanning in five-dot increments is continued during this process (see FIG. 10).

All the nozzles of each nozzle array are then used, sub-scanning is performed in 13-dot increments, and images are printed in the region Rm when the front edge Pf of the printing paper P travels a specific distance in the direction of sub-scanning after passing over the downstream slot 26$m$Y (see FIGS. 13 and 16).

As the rear edge Pr of the printing paper subsequently approaches the upstream slot 26$m$C, sub-scanning is again performed in five-dot increments, and images are printed in the region Rr with those nozzles of each nozzle array that are disposed above the slot. Specifically, images are printed with Nos. 9–13 in the case of yellow and light magenta, Nos. 5–9 in the case of magenta and light cyan, and Nos. 1–5 in the case of cyan and black.

Ink drops are ejected and dots are recorded to form images in the side edge portions of the printing paper P when nozzles are disposed opposite the side edge portions of the printing paper P, and a facing arrangement is established with the left slot 26$a$ (or right slot 26$b$) and the area outside the printing paper P in the same manner as in the first working example (see FIG. 12).

In the second working example, dots in the middle area of the printing paper between the upper and lower edges are formed by both specific slot-facing nozzles (dot-forming elements) and other nozzles. The printing in the middle area is performed with the sub-scanning of the feed rate greater than that in the edge portions. Accordingly, printing can be performed faster than when specific slot-facing nozzles are constantly used and the sub-scanning is performed at a constant feed rate. Limiting such full-nozzle printing to the middle portion of the printing paper P reduces the risk that the ejected ink drops will miss the upper or lower edge of the printing paper and soil the platen. In addition, the left slot 26$a$ and right slot 26$b$ extend from a point downstream of the position occupied by nozzle No. 1 in the yellow and light-magenta nozzle rows to a point upstream of the position occupied by nozzle No. 13 in the cyan and black nozzle rows (see FIG. 5). That prevents the upper surface of the platen 26 from being soiled when all the nozzles are used for printing images in the side edge portions of the printing paper.

The nozzles disposed above the slots are preferably used and sub-scanning performed in relatively small increments (five-dot increments in this case) when images are printed along the upper and lower edges of printing paper. In other words, sub-scanning must be performed in relatively small increments from the moment the front edge Pf of printing paper starts to pass over the slot 26$m$C until the moment the front edge completes its passage above the slot 26$m$Y. Sub-scanning also preferably is performed in relatively small increments from the moment the rear edge Pr of the printing paper starts to pass over the slot 26$m$C until the moment the rear edge completes its passage above the slot 26$m$Y. But to print images in the middle region Rm of the printing paper, it is possible to use all the nozzles and to perform sub-scanning in relatively large increments (13-dot increments in this case). In the second working example, the slots 26$m$C, 26$m$M, and 26$m$Y are disposed closer to each other than in the first working example. The distance over which the system is preferably sub-scanned in relatively small increments is therefore smaller, and the range within which the system can be sub-scanned in relatively large increments is larger. The total printing time can thus be reduced.

A printer in the second working example shown in FIGS. 14 and 15 may also be employed in the manner described with reference to the first working example. In such the printing, slot-facing nozzles alone are used to print images and sub-scanning feeding is performed with a constant pattern (for example, five-dot regular feeding) throughout the printing process.

A printer in the first working example shown in FIGS. 1 and 5 may also be employed in the manner described with reference to the second working example. In the printing images in the regions Rf and Rr in the vicinity of edge portions, slot-facing nozzles alone are used and sub-scanning feeding is performed with relatively small increments. In the printing images in the middle region Rm, more nozzles are used and sub-scanning feeding is performed with relatively big increments (see FIG. 16). Adopting such a printing procedure makes it possible to accelerate printing even when the printer shown in FIGS. 1 and 5 are used. Printing can be accelerated by setting up a narrower range for the slots in the direction of sub-scanning, as described with reference to the printer shown in FIGS. 14 and 15 (second working example).

D. Modifications

The present invention is not limited by the above-described working examples or embodiments and can be implemented in a variety of ways as long as the essence thereof is not compromised. For example, the following modifications are possible.

D1. Modification 1

The first working example was described with reference to a case in which slots 26*m*C, 26*m*M, and 26*m*Y were provided underneath nozzle Nos. 5–9 of each nozzle row, and margin-free printing was carried out in the first image print mode with the aid of nozzle Nos. 5–9. The second working example was described with reference to a case in which a slot 26*m*C was provided underneath nozzle Nos. 1–5 in the upstream nozzle rows, a slot 26*m*M was provided underneath nozzle Nos. 5–9 in the middle nozzle rows, a slot 26*m*Y was provided underneath nozzle Nos. 9–13 in the downstream nozzle rows. Margin-free printing was carried out in the first image print mode with the aid of the nozzles disposed above the slots.

However, the relation between the slots and the nozzles for printing images in the edge portions of printing paper is not limited to this arrangement alone. It is possible, for example, to adopt an arrangement in which each nozzle row contains 48 nozzles; slots 26*m*C, 26*m*M, and 26*m*Y are provided within a range that corresponds to nozzle Nos. 17–32; and images are printed in the first image print mode with nozzle Nos. 17–32.

D2. Modification 2

Although the first and second working examples were described with reference to cases in which color images were printed using inks of six colors, printing in color with only three inks (cyan, magenta, and yellow) is also a possibility. Color images can also be printed using four colors (cyan, magenta, yellow, and black). The arrangement shown in FIG. 4 may have a nozzle row for ejecting black ink instead of the light-cyan nozzle row (LC) and light-magenta nozzle row (LM). Adopting this arrangement makes it possible to perform rapid printing by ejecting black ink from three times as many nozzles (in comparison with the use of other inks) in a monochromatic mode for printing in black and white. In a color mode for printing in color, it is possible, for example, to limit black nozzles to the 13 nozzles disposed in the extreme upstream section (as viewed in the direction of sub-scanning).

D3. Modification 3

Figure 17:
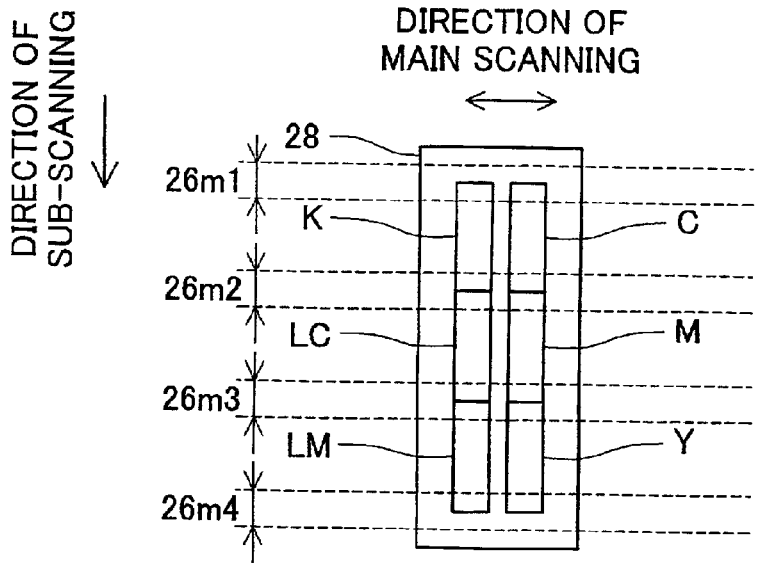
FIG. 17 is a diagram depicting the relation between slots and nozzle arrays according to another embodiment.

FIG. 17 is a diagram depicting the relation between slots and nozzle arrays according to another embodiment. In FIG. 17, the platen 26, itself disposed opposite the print head 28, is provided with slots at positions that correspond to ranges R26m1–R26m4. In the first and second working examples, each nozzle array was disposed opposite a single slot. It is, however, possible to adopt an arrangement in which each nozzle array faces two or more slots, as shown in FIG. 17. A single slot may also be disposed opposite two or more nozzle arrays. In the example shown in FIG. 17, the cyan nozzle row (C) and black nozzle row (K) are disposed opposite two slots located at positions corresponding to ranges R26m1 and R26m2. In other words, specific slot-facing, dot-forming element groups (nozzle groups used in the first image print mode) can be divided among a plurality of locations. In addition, the slot located at a position corresponding to the range R26m2 may be disposed opposite both a cyan nozzle row (C) and a magenta nozzle row (M) aligned in the direction of sub-scanning. Such arrangements allow images to be printed without any blank spaces in the edge portions of printing paper by printing these images in the upper and lower edge portions with the aid of slot-facing nozzles.

D4. Modification 4

Figure 18:
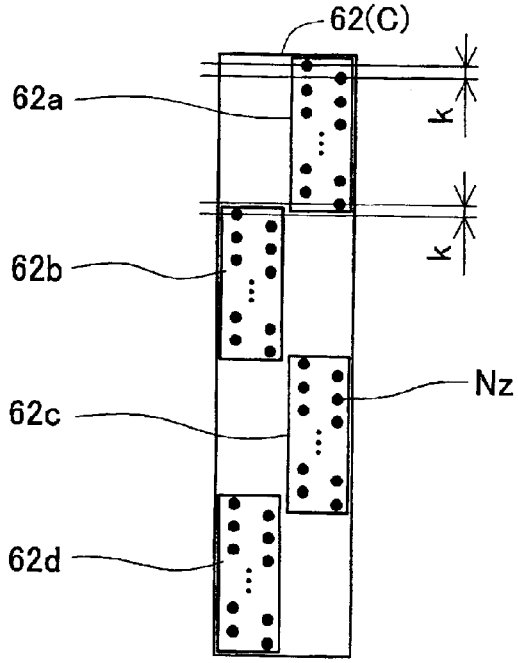
FIG. 18 is a diagram depicting the structure of a nozzle block according to another embodiment.
Figure 19:
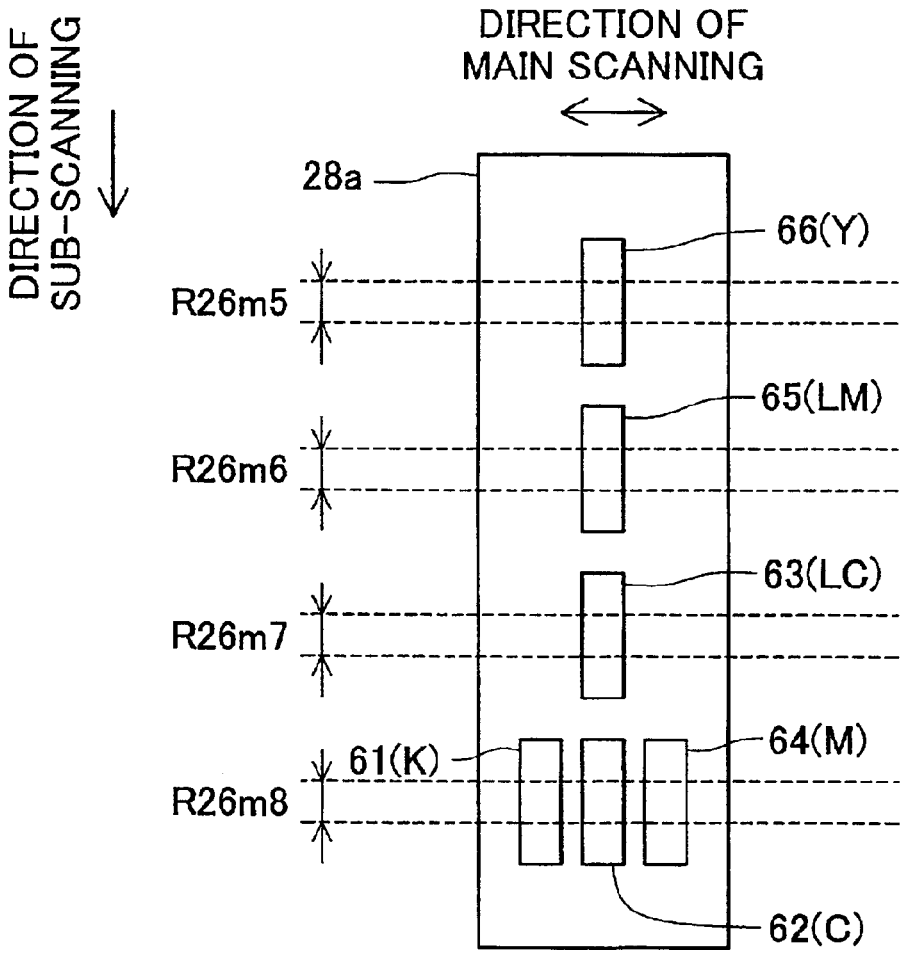
FIG. 19 is a diagram depicting the relation between the arrangement of nozzle blocks and the arrangement of slots according to another embodiment.
Figure 20:
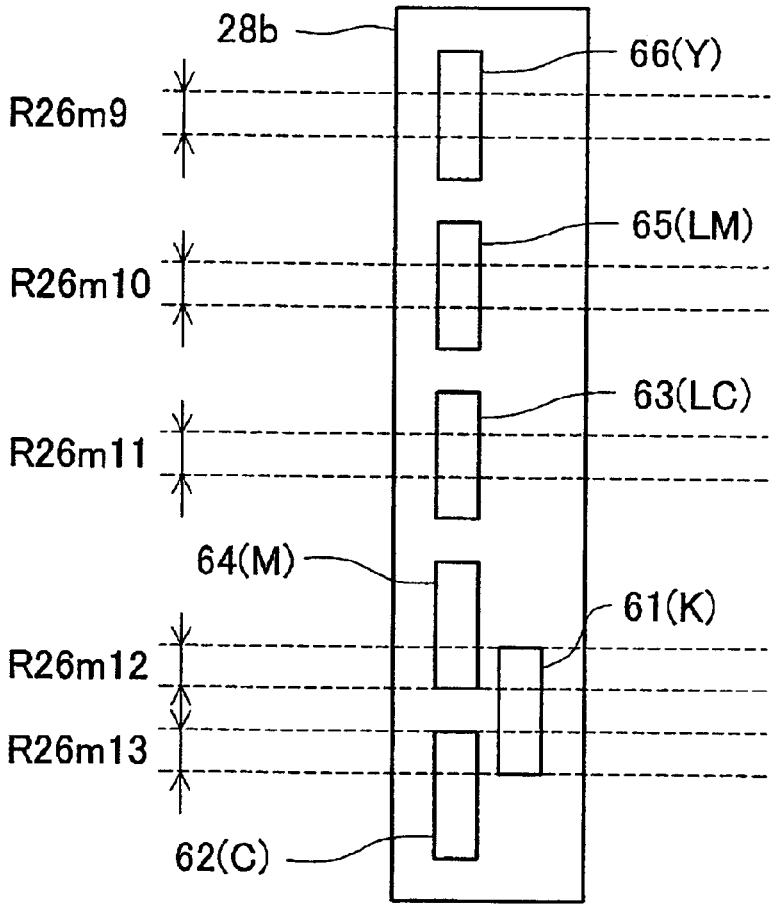
FIG. 20 is a diagram depicting the relation between the arrangement of nozzle blocks and the arrangement of slots according to yet another embodiment.

FIG. 18 is a diagram depicting the structure of a nozzle block pertaining to another embodiment. FIGS. 19 and 20 are diagrams depicting the relation between the arrangement of nozzle blocks and the arrangement of slots in accordance with other embodiments. In FIGS. 19 and 20, R26m5–R26m13 are slot-containing ranges on a platen that faces a print head. The first and second working examples were described with reference to cases in which the ejection heads 61–66 were arranged as a single-row nozzle array. As shown in FIG. 18, it is also possible to adopt an arrangement in which a plurality of nozzle units 62*a*–62*d* are grouped into a nozzle block 62 (ejection head 62), and the entire nozzle block 62 ejects ink of the same color (cyan ink in FIG. 18). In such an arrangement, a plurality of nozzle blocks 62–66 can be integrated into a print head 28 in the manner shown in FIG. 19. As is also shown in FIG. 19, one group of nozzle blocks (62, 63, 65, and 66) can be aligned in the direction of sub-scanning, and another group of nozzle blocks (61, 62, and 64) can be aligned in the direction of main scanning. In such an arrangement, some of the nozzle blocks (63, 65, and 66) not aligned in the direction of main scanning can be provided with individual nozzle-facing slots (slots placed at positions corresponding to ranges R26m5, R26m6, and R26m7, respectively), while the plurality of nozzle blocks 61, 62 and 64 aligned in the direction of main scanning can be provided with shared nozzle-facing slots (slots placed at positions corresponding to the range R26m8). The nozzle blocks may also be misaligned to partially overlap each other in the direction of main scanning, as shown in FIG. 20. In such cases, the nozzle blocks may be provided with individual nozzle-facing slots, or the slots may be provided in the ranges R26 m12 and R26 m13, and be shared by a plurality of nozzle blocks.

It is evident from the working examples and modifications described above that the present invention may be provided the platen with a plurality of slots. Each of the slots may extend in the direction of main scanning and has a width in the direction of sub-scanning that corresponds to part of the range of each nozzle group. The nozzle groups (dot-forming element groups) are disposed in mutually different positions in the direction of sub-scanning.

In the case that images are printed using nozzle groups disposed in the same position in the direction of sub-scanning, and ink drops ejected by such nozzle groups are deposited within the same pixel, there is a possibility that some ink drops will deposit without any interval during the same main scan. The deposited inks are likely to bleed into each other. However, such adjacent deposition may be avoided by adopting an arrangement in which images are printed using a plurality of nozzle groups disposed in mutually different positions in the direction of sub-scanning. In such arrangement, the ink drops will be deposited within the same pixel in a plurality of main scans with intervals in which sub-scannings are performed. The deposited inks are thus less likely to bleed into each other. In addition, the sequence in which ink drops are deposited within the same pixel may be fixed in such arrangement. In the previous main scan, the ink drops from the preceding nozzle are deposited. In the latter main scan, the ink drops from the following nozzle are deposited. A constant ink superposition sequence is thus maintained. Accordingly, the color in each pixel is stabilized and the quality of the print results is enhanced when inks of different colors are ejected from different nozzle groups during color printing.

D5. Modification 5

Figure 21:
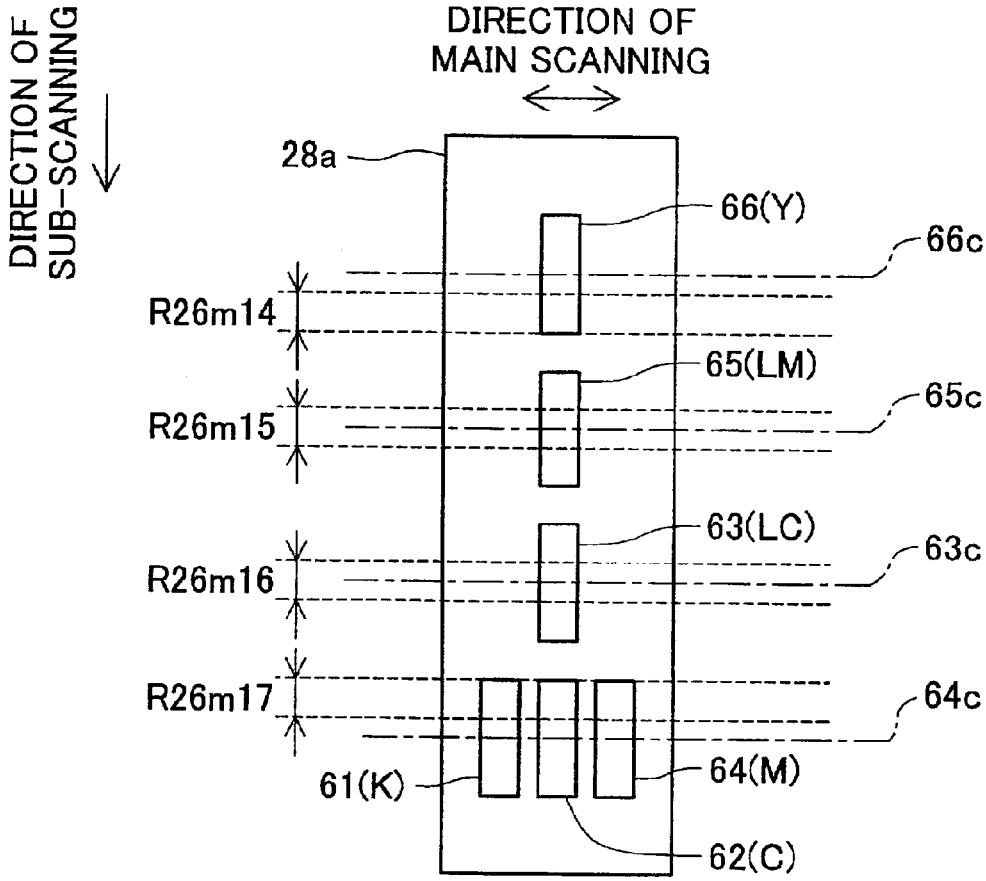
FIG. 21 is a diagram depicting the relation between the arrangement of nozzle blocks and the arrangement of slots according to still another embodiment.

FIG. 21 is a diagram depicting the relation between the arrangement of nozzle blocks and the arrangement of slots in accordance with another embodiment. The print head 28*a* shown in FIG. 21 has the same structure as the print head 28*a* shown in FIG. 19. FIG. 21 depicts a central position 66*c* in the direction of sub-scanning in an area containing yellow nozzles on an ejection head 66. Also shown are central positions 65*c*, 63*c*, and 64*c* in the direction of sub-scanning in an area containing nozzles of each color on ejection heads 65, 63, and 64. The central position 64*c* is disposed in the direction of sub-scanning in an area containing black and cyan nozzles.

In FIG. 21, the slot located at a position corresponding to the range R26m15 faces light-magenta nozzles disposed within a prescribed range near the central position 65*c* of the light-magenta nozzle group. The slot located at a position corresponding to the range R26m16 faces light-cyan nozzles disposed within a prescribed range near the central position 63*c* of the light-cyan nozzle group. For this reason, higher-quality images can be printed in the first image print mode when nozzles disposed closer to the center eject ink drops whose size or dot formation positions are closer to design values than those provided by nozzles disposed closer to edges.

It can also be seen in FIG. 21 that the slot located at a position corresponding to the range R26 m14 in the extreme upstream section in the direction of sub-scanning is disposed downstream in relation to the central position 66*c* of a yellow nozzle group Y that faces this slot in the direction of sub-scanning. It can further be seen that the slot located at a position corresponding to the range R26m17 in the extreme downstream section in the direction of sub-scanning is disposed upstream in relation to the central position 64*c* of a magenta group M that faces this slot in the direction of sub-scanning. Adopting this arrangement makes it possible to narrow the range on the printing paper within which dots must be recorded solely with slot-facing nozzles (specific dot-forming elements). More-rapid printing can therefore be achieved. The same effect is obtained when intermediately disposed slots (slots in the ranges R26m15 and R26 m16) are placed closer to the central positions 65*c* and 63*c* of the slot-facing nozzles.

The phrase that slots are disposed downstream in relation to the central position of a nozzle group (dot-forming element group) in the direction of sub-scanning does not necessarily mean that the entire range for accommodating the slots in the direction of sub-scanning lies downstream in relation to the central position of the slot-facing nozzle group. In other words, any arrangement is acceptable as long as the central position of a slot in the direction of sub-scanning lies downstream in relation to the central position of the slot-facing nozzle group in the direction of sub-scanning. The same applies to the statement that a slot is disposed upstream in relation to the central position of a nozzle group in the direction of sub-scanning.

D6. Modification 6

In the above working examples, software can be used to perform some hardware functions, or, conversely, hardware can be used to perform some software functions. For example, a host computer 90 can be used to perform some of the functions assigned to the CPU 41 (see FIG. 3).

The computer programs for performing such functions may be supplied as programs stored on floppy disks, CD-ROMs, and other types of computer-readable recording media. The host computer 90 may read the computer programs from these recording media and transfer the data to internal or external storage devices. Alternatively, the computer programs can be installed on the host computer 90 from a program-supplying device via a communications line. Computer programs stored by an internal storage device are executed by the host computer 90 when the functions of the computer programs are to be performed. Alternatively, computer programs stored on a storage medium may be executed directly by the host computer 90.

As used herein, the term "host computer 90" refers both to a hardware device and to an operating system, and designates a hardware device capable of operating under the control of an operating system. Computer programs allow such a host computer 90 to perform the functions of the above-described units. Some of the aforementioned functions can be performed by an operating system rather than an application program.

As used herein, the term "computer-readable recording medium" is not limited to a portable recording medium such as a floppy disk or a CD-ROM and includes various RAMs, ROMs, and other internal computer storage devices as well as hard disks and other external storage devices fixedly mounted in the computer.

Although the present invention has been described and illustrated in detail, it is clearly understood that the same is by way of illustration and example only and is not to be taken by way of limitation, the spirit and scope of the present invention limited only by the terms of the appended

What is claimed is:

1. A dot-recording device for recording dots on a surface of a print medium by ejecting ink drops while a main scan is performed, the dot recording device comprising:

a dot-recording head provided with a plurality of dot-forming element groups each of which comprises dot-forming elements for ejecting ink drops of a same color and occupies a different position in a direction of sub-scanning oriented across a direction of main scanning;

a main scanning unit configured to perform main scanning by moving the dot-recording head and/or the print medium;

a head driver configured to drive at least some of the dot-forming elements to form dots in the course of main scanning;

a platen that extends in a direction of main scanning while disposed opposite the dot-forming elements at least along part of a main scan pass, and that supports the print medium at a position opposite the dot-recording head;

a sub-scanning unit configured to perform sub-scanning in between the main scans by moving the print medium in the direction of sub-scanning; and a control unit configured to control printing, wherein the platen comprises a plurality of slots that are extended in the direction of main scanning and are configured such that a width of the slot in the sub-scanning direction corresponds to not the entirety but part of a range of each dot-forming element group in the direction of sub-scanning.

2. A dot-recording device as defined in claim 1, wherein each of the dot-forming element groups comprises a specific dot-forming element sub-group composed of specific dot-forming elements disposed within specific ranges commensurate with the width of the plurality of slots in the direction of sub-scanning; and the control unit comprises a first control unit that uses only the specific dot-forming element sub-groups to form dots at least in an edge portion not to have blank space in a first image print mode for printing images all the way to edges of the print medium without leaving blank spaces along an upper edge and/or a lower edge of the print medium.

3. A dot-recording device as defined in claim 2, wherein the specific dot-forming element sub-groups in the plurality of dot-forming element groups have an identical number of dot forming elements.

4. A dot-recording device as defined in claim 2, wherein at least one of the specific dot-forming element sub-groups is located in a plurality of divided locations; and the platen is provided with a plurality of the slots that are positioned opposite the specific dot-forming element sub-group at the plurality of divided locations.

5. A dot-recording device as defined in claim 2, wherein the platen comprises:

upstream support portions each configured to support the print medium on upstream side of each slot in the direction of main scanning, and downstream support portions each configured to support the print medium on downstream side of each slot in the direction of main scanning.

6. A dot-recording device as defined in claim 2, wherein each of the specific dot-forming element sub-groups includes at least one dot-forming element disposed within a specific range near a center of each dot-forming element group in the direction of sub-scanning.

7. A dot-recording device as defined in claim 2, wherein the first control unit uses only the specific dot-forming element sub-groups to form all dots on the print medium in the first image print mode.

8. A dot-recording device as defined in claim 7, wherein a length of each slot in the direction of main scanning is greater than a width of a print medium having a specific standard size usable in the dot recording device, and the first control unit comprises a side edge print unit configured to cause the dot recording head to eject ink drops from dot-forming elements selected from the specific dot-forming element sub-groups into an area near a side edge portion of the print medium supported on the platen to print images without leaving blank spaces in the side edge portion.

9. A dot-recording device as defined in claim 2, wherein for dot recording in a middle portion located between the upper and lower edges of the print medium in the first image print mode, the first control unit uses the specific dot-forming elements in the specific dot-forming element sub-groups and dot-forming elements other than the specific dot-forming element sub-groups; and performs the sub-scanning in greater increments than feed increments of sub-scanning in the edge portions.

10. A dot-recording device as defined in claim 9, wherein a specific one of the slots disposed in an extreme upstream section in the direction of sub-scanning is located on downstream side in relation to a central position of a dot-forming element group facing the slot in the extreme upstream section in the direction of sub-scanning, and a specific one of the slots disposed in an extreme downstream section in the direction of sub-scanning is located on upstream side in relation to a central position of a dot-forming element group facing the slot in the extreme downstream section in the direction of sub-scanning.

11. A dot-recording device as defined in claim 9, wherein the platen further comprises a pair of lateral slots disposed at a distance substantially equal to a width of a specific sized print medium in the direction of main scanning within a range that allows ink drops to be deposited by the plurality of dot-forming elements in the direction of sub-scanning, the dot-recording device comprises a guide configured to position the print medium in the direction of main scanning such that the specific sized print medium can be supported on the platen and two side edges of the print medium can be kept at positions above openings of the lateral slots, and the first control unit comprises a side edge print unit configured to cause the dot recording head to eject ink drops from dot-forming elements selected from the specific dot-forming element sub-groups into an area near a side edge portion of the print medium supported on the platen to print images without leaving blank spaces in the side edge portion.

12. A dot-recording device as defined in any of claims 2 to 11, wherein the control unit further comprises a second control unit that uses the specific dot-forming elements in the specific dot-forming element sub-groups and dot-forming elements other than the specific dot-forming element sub-groups to form dots in a second image print mode for printing images leaving blank spaces along the upper and lower edges of the print medium.

13. A dot-recording method involving use of a dot-recording device provided with a plurality of dot-forming element groups at mutually different positions in a direction of sub-scanning, whereby main scanning is carried out by moving a dot-recording head and/or print medium across the direction of sub-scanning while forming dots, and sub-scanning is carried out between the main scannings by moving the print medium in the direction of sub-scanning, wherein the dot-recording method comprising:

(a) preparing a platen provided with a plurality of slots that extend in a direction of main scanning at positions opposite the plurality of dot-forming element groups; and (b) forming dots using only specific dot-forming elements disposed within specific ranges commensurate with the plurality of slots at least in forming dots in an edge portion not to have blank space in a first image print mode for printing images all the way to edges of the print medium without leaving blank spaces along an upper edge and/or a lower edge of the print medium.

14. A dot-recording method as defined in claim 13, wherein the step (b) comprises a step in which the specific dot-forming elements are only used to form all dots on the print medium in the first image print mode.

15. A dot-recording method as defined in claim 14, wherein a length of each slot in the direction of main scanning is greater than a width of a print medium having a specific standard size usable in the dot recording device, and the dot-recording method further comprising the step of:

(c) ejecting ink drops from dot-forming elements selected from the specific dot-forming element sub-groups into an area near a side edge portion of the print medium supported on the platen to print images without leaving blank spaces in the side edge portions.

16. A dot-recording method as defined in claim 13, wherein the step (b) comprises the step of:

recording dots in a middle portion located between the upper and lower edges of the print medium in the first image print mode by using the specific dot-forming elements in the specific dot-forming element sub-groups and dot-forming elements other than the specific dot-forming element sub-groups; and by performing the sub-scanning in greater increments than feed increments of sub-scanning in the edge portions.

17. A dot-recording method as defined in claim 16, wherein the platen further comprises a pair of lateral slots disposed at a distance substantially equal to a width of a specific sized print medium in the direction of main scanning within a range that allows ink drops to be deposited by the plurality of dot-forming elements in the direction of sub-scanning, and the dot-recording method further comprising the step of (c) placing the print medium in the direction of main scanning such that the specific sized print medium can be supported on the platen and two side edges of the print medium can be kept at positions above openings of the lateral slots, and (d) ejecting ink drops from dot-forming elements selected from the specific dot-forming element sub-groups into an area near a side edge portion of the print medium supported on the platen to print images without leaving blank spaces in the side edge portion.

18. A dot-recording method as defined in any of claims 13 to 17, further comprising a step of:

(e) forming dots by using specific dot-forming elements and dot-forming elements other than the specific dot-forming elements in a second image print mode for printing images leaving blank spaces along the upper and lower edges of the print medium.

19. A dot-recording method involving use of a dot-recording device provided with a plurality of dot-forming elements, whereby main scanning is carried out by moving a dot-recording head and/or print medium while forming dots by driving at least part of the dot-forming elements, and sub-scanning is carried out between the main scannings by moving the print medium in a direction of sub-scanning, wherein the dot-recording method comprising:

(a) preparing a dot-recording head provided with a plurality of dot-forming element groups, the dot forming element groups ejecting ink drops of a same color and occupying a different position in a direction of sub-scanning, the dot forming element group comprising a specific dot-forming element subgroup composed of specific dot-forming elements disposed within specific ranges; and also preparing a platen that extends in a direction of main scanning while disposed opposite the dot-forming element groups at least along part of a main scan pass, and that supports the print medium at a position opposite the dot-recording head, and provided with a plurality of slots that extend in the direction of main scanning at positions opposite the plurality of dot-forming element groups, (b) selecting between a first image print mode for printing images all the way to edges without leaving blank spaces along an upper edge and/or a lower edge of the print medium, and a second image print mode for printing images while leaving blank spaces along the upper and lower edges of the print medium;

(c) forming dots by using only the specific dot-forming elements to form dots at least in edge portions of the print medium without blank spaces in a case that the first image print mode is selected; and (d) forming dots by using the specific dot-forming elements and dot-forming elements other than the specific dot-forming elements to form dots in a case that the second image print mode is selected.

20. A computer-readable storage medium containing a computer program for making a computer with a dot-recording device to perform main scanning by moving a dot-recording head and/or a print medium across a direction of sub-scanning while forming dots, and to perform sub-scanning between the main scannings by moving the print medium in the direction of sub-scanning, the dot-recording device comprising:

a dot-recording head provided with a plurality of dot-forming element groups composed of dot-forming elements, the dot-forming elements in one dot-forming element group being configured to eject ink drops of a same color, the plurality of dot-forming element groups comprising at least two dot-forming element groups disposed at mutually different positions in the direction of sub-scanning, each of the dot-forming element groups comprising a specific dot-forming element sub-group composed of specific dot-forming elements disposed within a specific range in the direction of sub-scanning, a platen designed extends in a direction of main scanning while disposed opposite the dot-forming element groups at least along part of a main scan pass, and that supports the print medium at a position opposite the dot-recording head, and provided with a plurality of slots that extend in the direction of main scanning at positions opposite the plurality of dot-forming element groups; and the storage medium contains a computer program for causing the computer to form dots using only specific dot-forming element sub-groups disposed within specific ranges commensurate with the plurality of slots at least in forming dots in an edge portion of the print medium not to have blank spaces in a first image print mode for printing images all the way to edges of the print medium without leaving blank spaces along an upper edge and/or a lower edge of the print medium.

21. A computer-readable storage medium as defined in claim 20, further containing:

a computer program for causing the computer to use only the specific dot-forming element sub-groups to form all dots on the print medium in the first image print mode.

22. A computer-readable storage medium as defined in claim 21, wherein a length of each slot in the direction of main scanning is greater than a width of a print medium having a specific standard size usable in the dot recording device, and the storage medium further containing:

a computer program for causing the computer with the dot recording head to eject ink drops from dot-forming elements selected from the specific dot-forming element sub-groups into an area near a side edge portion of the print medium supported on the platen to print images without leaving blank spaces in the side edge portions.

23. A computer-readable storage medium as defined in claim 20, further containing:

a computer program for causing the computer to record dots in a middle portion located between the upper and lower edges of the print medium in the first image print mode by using the specific dot-forming elements in the specific dot-forming element sub-groups and dot-forming elements other than the specific dot-forming element sub-groups; and by performing the sub-scanning in greater increments than feed increments of sub-scanning in the edge portions.

24. A computer-readable storage medium as defined in claim 23, wherein the platen further comprises a pair of lateral slots disposed at a distance substantially equal to a width of a specific sized print medium in the direction of main scanning within a range that allows ink drops to be deposited by the plurality of dot-forming elements in the direction of sub-scanning, and the dot recording device further comprises a guide configured to position the print medium in the direction of main scanning such that the specific sized print medium can be supported on the platen and two side edges of the print medium can be kept at positions above openings of the lateral slots, and the storage medium further containing:

a computer program for causing the computer to eject ink drops from dot-forming elements selected from the specific dot-forming element sub-groups into an area near a side edge portion of the print medium supported on the platen to print images without leaving blank spaces in side edge portions.

25. A computer-readable storage medium as defined in any of claims 20 to 24, further comprising:

a computer program for causing the computer to use specific dot-forming elements and dot-forming elements other than the specific dot-forming elements to form dots in a second image print mode for printing images leaving blank spaces along the upper and lower edges of the print medium.

26. A computer-readable storage medium containing a computer program for making a computer with a dot recording device to perform main scanning by moving a dot-recording head and/or a print medium across a direction of sub-scanning while forming dots, and to perform sub-scanning between the main scannings by moving the print medium in the direction of sub-scanning, the dot-recording device comprising:

a dot-recording head provided with a plurality of dot-forming element groups composed of dot-forming elements, the dot-forming elements in one dot-forming element group being configured to eject ink drops of a same color, the plurality of dot-forming element groups comprising at least two dot-forming element groups disposed at mutually different positions in the direction of sub-scanning, each of the dot-forming element groups comprising a specific dot-forming element sub-group composed of specific dot-forming elements disposed within a specific range in the direction of sub-scanning, a platen designed extends in a direction of main scanning while disposed opposite the dot-forming element groups at least along part of a main scan pass, and that supports the print medium at a position opposite the dot-recording head, and provided with a plurality of slots that extend in the direction of main scanning at positions opposite the plurality of dot-forming element groups; and the storage medium contains:

a computer program for causing a computer to display on a display a selection screen for permitting user to select a first image print mode or a second image print mode, and for receiving the user's selection, the first image print mode being such that images are printed all the way to edges without leaving blank spaces along an upper edge and/or a lower edge of the print medium, and the second image print mode being such that images are printed while leaving blank spaces along the upper and lower edges of the print medium;

a computer program for causing a computer to form dots by using only the specific dot-forming elements to form at least in edge portions of the print medium without blank spaces in a case that the first image print mode is selected; and a computer program for causing a computer to form dots by using the specific doting forming elements and dot-forming elements other than the specific dot-forming elements to form dots in a case that the second image print mode is selected.

* * * * *